US007775243B2

(12) United States Patent
Hack-Ueberall et al.

(10) Patent No.: US 7,775,243 B2
(45) Date of Patent: Aug. 17, 2010

(54) FORMING FABRIC FOR A MACHINE FOR THE PRODUCTION OF WEB MATERIAL, ESPECIALLY PAPER OR CARDBOARD

(75) Inventors: Petra Hack-Ueberall, Langenau (DE); Johann Boeck, Neufelden (AT)

(73) Assignee: Voith Patent GmbH, Heidenheim (DE)

( * ) Notice: Subject to any disclaimer, the term of this patent is extended or adjusted under 35 U.S.C. 154(b) by 15 days.

(21) Appl. No.: 12/195,859

(22) Filed: Aug. 21, 2008

(65) Prior Publication Data

US 2009/0035537 A1 Feb. 5, 2009

Related U.S. Application Data

(63) Continuation of application No. PCT/EP2007/050486, filed on Jan. 18, 2007.

(30) Foreign Application Priority Data

Feb. 25, 2006 (DE) ..... 10 2006 008 812
Jun. 22, 2006 (DE) ..... 10 2006 028 630

(51) Int. Cl.
*D21F 1/10* (2006.01)
*D21F 7/08* (2006.01)
*D03D 25/00* (2006.01)

(52) U.S. Cl. ..... 139/383 A; 139/383 R; 139/383 AA; 162/358.2

(58) Field of Classification Search ..... 139/383 R, 139/383 AA, 383 A; 162/358.2, 348, 349
See application file for complete search history.

(56) References Cited

U.S. PATENT DOCUMENTS

| | | | | | |
|---|---|---|---|---|---|
| 4,171,009 | A * | 10/1979 | Karm | 139/425 A |
| 4,408,637 | A * | 10/1983 | Karm | 139/425 A |
| 5,016,678 | A * | 5/1991 | Borel et al. | 139/383 A |
| 5,077,116 | A * | 12/1991 | Lefkowitz | 428/141 |
| 5,100,713 | A * | 3/1992 | Homma et al. | 428/102 |
| 5,141,031 | A * | 8/1992 | Baurmeister | 139/383 R |
| 5,544,678 | A * | 8/1996 | Barrett | 139/383 A |
| 6,334,467 | B1 * | 1/2002 | Barrett et al. | 139/383 A |
| 7,007,722 | B2 * | 3/2006 | Quigley et al. | 139/383 A |
| 2004/0149342 | A1 * | 8/2004 | Troughton | 139/383 R |
| 2005/0103397 | A1 * | 5/2005 | Quigley et al. | 139/383 A |
| 2006/0016508 | A1 * | 1/2006 | Westerkamp et al. | 139/383 R |
| 2007/0111625 | A1 * | 5/2007 | Morton | 442/270 |

* cited by examiner

*Primary Examiner*—Bobby H Muromoto, Jr.
(74) *Attorney, Agent, or Firm*—Taylor IP, P.C.

(57) ABSTRACT

A forming fabric for a machine for the production of web material, especially paper or cardboard, comprises a first fabric layer on the web material side and a second machine-side fabric layer, whereby the first fabric layer and the second fabric layer are interconnected with each other by binder threads and whereby the second fabric layer is woven in an irregular satin weave.

23 Claims, 26 Drawing Sheets

| | 2 | 4 | 6 | 8 | 10 | 12 | 14 | 16 | | | | | | | | |
|---|---|---|---|---|---|---|---|---|---|---|---|---|---|---|---|---|
| 1 | ■ | | | | | | | | ■ | | | | | | | |
| 1 | | | | | | | X | | | | | | | | X | |
| 2 | | | | 0 | | | | | | | | 0 | | | | |
| 2 | | | ■ | | | | | | | | ■ | | | | | |
| 3 | | | | | 0 | | | | | | | | 0 | | | |
| 4 | | X | | | | | | | | X | | | | | | |
| 3 | | | | | | ■ | | | | | | | | ■ | | |
| 5 | | | X | | | | | | | | X | | | | | |
| 6 | | | | | | | 0 | | | | | | | | 0 | |
| 4 | | | | | | | | ■ | | | | | | | | ■ |
| 7 | 0 | | | | | | | | 0 | | | | | | | |
| 8 | | | | X | | | | | | | | X | | | | |
| 5 | | | | | ■ | | | | | | | | ■ | | | |
| 9 | | | | | | | X | | | | | | | | X | |
| 10 | | | 0 | | | | | | | | 0 | | | | | |
| 6 | | ■ | | | | | | | | ■ | | | | | | |
| 11 | | | | | 0 | | | | | | | | 0 | | | |
| 12 | X | | | | | | | | X | | | | | | | |
| 7 | | | | | | | ■ | | | | | | | | ■ | |
| 13 | | | X | | | | | | | | X | | | | | |
| 14 | | | | | | | | 0 | | | | | | | | 0 |
| 8 | | | | ■ | | | | | | | | ■ | | | | |
| 15 | | 0 | | | | | | | | 0 | | | | | | |
| 16 | | | | | X | | | | | | | | X | | | |

Fig. 3

| | 2 | 4 | 6 | 8 | 10 | 12 | 14 | 16 | | | | | | | | |
|---|---|---|---|---|---|---|---|---|---|---|---|---|---|---|---|---|
| 8 | | | | X | | | | | | | | X | | | | |
| 7 | X | | | | | | | | X | | | | | | | |
| 6 | | | | | | | X | | | | | | | | X | |
| 5 | | | | | X | | | | | | | | X | | | |
| 4 | | X | | | | | | | | X | | | | | | |
| 3 | | | | | | | | X | | | | | | | | X |
| 2 | | | X | | | | | | | | X | | | | | |
| 1 | | | | | | X | | | | | | | | X | | |
| 8 | | | | X | | | | | | | | X | | | | |
| 7 | X | | | | | | | | X | | | | | | | |
| 6 | | | | | | | X | | | | | | | | X | |
| 5 | | | | | X | | | | | | | | X | | | |
| 4 | | X | | | | | | | | X | | | | | | |
| 3 | | | | | | | | X | | | | | | | | X |
| 2 | | | X | | | | | | | | X | | | | | |
| 1 | | | | | | X | | | | | | | | X | | |
| 8 | | | | X | | | | | | | | X | | | | |
| 7 | X | | | | | | | | X | | | | | | | |
| 6 | | | | | | | X | | | | | | | | X | |
| 5 | | | | | X | | | | | | | | X | | | |
| 4 | | X | | | | | | | | X | | | | | | |
| 3 | | | | | | | | X | | | | | | | | X |
| 2 | | | X | | | | | | | | X | | | | | |
| 1 | | | | | | X | | | | | | | | X | | |
| 8 | | | | X | | | | | | | | X | | | | |
| 7 | X | | | | | | | | X | | | | | | | |
| 6 | | | | | | | X | | | | | | | | X | |
| 5 | | | | | X | | | | | | | | X | | | |
| 4 | | X | | | | | | | | X | | | | | | |
| 3 | | | | | | | | X | | | | | | | | X |
| 2 | | | X | | | | | | | | X | | | | | |
| 1 | | | | | | X | | | | | | | | X | | |

Fig. 4

| | | 2 | 4 | 6 | 8 | 10 | 12 | 14 | 16 | | | | | | | | |
|---|---|---|---|---|---|---|---|---|---|---|---|---|---|---|---|---|---|
| | 1 | | | | | | ■ | | | | | | | | ■ | | |
| 1 | | | | | | | | X | | | | | | | | X | |
| 2 | | | | | 0 | | | | | | | | 0 | | | | |
| | 2 | | | ■ | | | | | | | | ■ | | | | | |
| 3 | | | | | | 0 | | | | | | | | 0 | | | |
| 4 | | X | | | | | | | | X | | | | | | | |
| | 3 | | | | | | | | ■ | | | | | | | | ■ |
| 5 | | | | X | | | | | | | | X | | | | | |
| 6 | | | | | | | | 0 | | | | | | | | 0 | |
| | 4 | | ■ | | | | | | | | ■ | | | | | | |
| 7 | | 0 | | | | | | | | 0 | | | | | | | |
| 8 | | | | | X | | | | | | | | X | | | | |
| | 5 | | | | | ■ | | | | | | | | ■ | | | |
| 9 | | | | | | | X | | | | | | | | X | | |
| 10 | | | | 0 | | | | | | | | 0 | | | | | |
| | 6 | | | | | | | ■ | | | | | | | | ■ | |
| 11 | | | | | | 0 | | | | | | | | 0 | | | |
| 12 | | | X | | | | | | | | X | | | | | | |
| | 7 | ■ | | | | | | | | ■ | | | | | | | |
| 13 | | | | X | | | | | | | | X | | | | | |
| 14 | | | | | | | | | 0 | | | | | | | | 0 |
| | 8 | | | | ■ | | | | | | | | ■ | | | | |
| 15 | | 0 | | | | | | | | 0 | | | | | | | |
| 16 | | | | | | X | | | | | | | | X | | | |

Fig. 6

| | 2 | 4 | 6 | 8 | 10 | 12 | 14 | 16 | | | | | | | | |
|---|---|---|---|---|---|---|---|---|---|---|---|---|---|---|---|---|
| 8 | | | | X | | | | | | | | X | | | | |
| 7 | | X | | | | | | | | X | | | | | | |
| 6 | | | | | | | X | | | | | | | | X | |
| 5 | | | | | X | | | | | | | | X | | | |
| 4 | | | | | | | | X | | | | | | | | X |
| 3 | | | | | | X | | | | | | | | X | | |
| 2 | | | X | | | | | | | | X | | | | | |
| 1 | X | | | | | | | | X | | | | | | | |
| 8 | | | | X | | | | | | | | X | | | | |
| 7 | | X | | | | | | | | X | | | | | | |
| 6 | | | | | | | X | | | | | | | | X | |
| 5 | | | | | X | | | | | | | | X | | | |
| 4 | | | | | | | | X | | | | | | | | X |
| 3 | | | | | | X | | | | | | | | X | | |
| 2 | | | X | | | | | | | | X | | | | | |
| 1 | X | | | | | | | | X | | | | | | | |
| 8 | | | | X | | | | | | | | X | | | | |
| 7 | | X | | | | | | | | X | | | | | | |
| 6 | | | | | | | X | | | | | | | | X | |
| 5 | | | | | X | | | | | | | | X | | | |
| 4 | | | | | | | | X | | | | | | | | X |
| 3 | | | | | | X | | | | | | | | X | | |
| 2 | | | X | | | | | | | | X | | | | | |
| 1 | X | | | | | | | | X | | | | | | | |
| 8 | | | | X | | | | | | | | X | | | | |
| 7 | | X | | | | | | | | X | | | | | | |
| 6 | | | | | | | X | | | | | | | | X | |
| 5 | | | | | X | | | | | | | | X | | | |
| 4 | | | | | | | | X | | | | | | | | X |
| 3 | | | | | | X | | | | | | | | X | | |
| 2 | | | X | | | | | | | | X | | | | | |
| 1 | X | | | | | | | | X | | | | | | | |

Fig. 7

| | | 2 | 4 | 6 | 8 | 10 | 12 | 14 | 16 | | | | | | | | |
|---|---|---|---|---|---|---|---|---|---|---|---|---|---|---|---|---|---|
| | 1 | ■ | | | | | | | | ■ | | | | | | | |
| 1 | | | | | | | | X | | | | | | | | X | |
| 2 | | | | | 0 | | | | | | | | 0 | | | | |
| | 2 | | | ■ | | | | | | | | ■ | | | | | |
| 3 | | | | | | 0 | | | | | | | | 0 | | | |
| 4 | | X | | | | | | | | X | | | | | | | |
| | 3 | | | | | | ■ | | | | | | | | ■ | | |
| 5 | | | | X | | | | | | | | X | | | | | |
| 6 | | | | | | | | 0 | | | | | | | | 0 | |
| | 4 | | | | | | | | ■ | | | | | | | | ■ |
| 7 | | 0 | | | | | | | | 0 | | | | | | | |
| 8 | | | | | X | | | | | | | | X | | | | |
| | 5 | | | | | ■ | | | | | | | | ■ | | | |
| 9 | | | | | | | X | | | | | | | | X | | |
| 10 | | | | 0 | | | | | | | | 0 | | | | | |
| | 6 | | | | | | | ■ | | | | | | | | ■ | |
| 11 | | | | | | 0 | | | | | | | | 0 | | | |
| 12 | | X | | | | | | | | X | | | | | | | |
| | 7 | | ■ | | | | | | | | ■ | | | | | | |
| 13 | | | | X | | | | | | | | X | | | | | |
| 14 | | | | | | | | | 0 | | | | | | | | 0 |
| | 8 | | | | ■ | | | | | | | | ■ | | | | |
| 15 | | | 0 | | | | | | | | 0 | | | | | | |
| 16 | | | | | | X | | | | | | | | X | | | |

Fig. 9

| | | 2 | 4 | 6 | 8 | 10 | 12 | 14 | 16 | | | | | | | | |
|---|---|---|---|---|---|---|---|---|---|---|---|---|---|---|---|---|---|
| | 1 | ■ | | | | | | | | ■ | | | | | | | |
| 1 | | | | | | | | X | | | | | | | | X | |
| 2 | | | | | 0 | | | | | | | | 0 | | | | |
| | 2 | | | ■ | | | | | | | | ■ | | | | | |
| 3 | | | | | 0 | | | | | | | | 0 | | | | |
| 4 | | | X | | | | | | | | X | | | | | | |
| | 3 | | | | | ■ | | | | | | | | ■ | | | |
| 5 | | | X | | | | | | | | X | | | | | | |
| 6 | | | | | | | | 0 | | | | | | | | 0 | |
| | 4 | | | | | | | | ■ | | | | | | | | ■ |
| 7 | | 0 | | | | | | | | 0 | | | | | | | |
| 8 | | | | | | | X | | | | | | | | X | | |
| | 5 | | | | ■ | | | | | | | | ■ | | | | |
| 9 | | | | | | | X | | | | | | | | X | | |
| 10 | | | | 0 | | | | | | | | 0 | | | | | |
| | 6 | | | | | | | ■ | | | | | | | | ■ | |
| 11 | | | | | | 0 | | | | | | | | 0 | | | |
| 12 | | X | | | | | | | | X | | | | | | | |
| | 7 | | ■ | | | | | | | | ■ | | | | | | |
| 13 | | | | X | | | | | | | | X | | | | | |
| 14 | | | | | | | | | 0 | | | | | | | | 0 |
| | 8 | | | | | | ■ | | | | | | | | ■ | | |
| 15 | | | | | | | | | 0 | | | | | | | | 0 |
| 16 | | | | | | X | | | | | | | | X | | | |

Fig. 12

| | 2 | 4 | 6 | 8 | 10 | 12 | 14 | 16 | | | | | | | | |
|---|---|---|---|---|---|---|---|---|---|---|---|---|---|---|---|---|
| 1 | ■ | | | | | | | | ■ | | | | | | | |
| 1 | | | | | | | X | | | | | | | | X | |
| 2 | | 0 | | | | | | | | 0 | | | | | | |
| 2 | | | ■ | | | | | | | | ■ | | | | | |
| 3 | | | | | 0 | | | | | | | | 0 | | | |
| 4 | | X | | | | | | | | X | | | | | | |
| 3 | | | | | | ■ | | | | | | | | ■ | | |
| 5 | | | | X | | | | | | | | X | | | | |
| 6 | | | | | | | 0 | | | | | | | | 0 | |
| 4 | | | | | | | | ■ | | | | | | | | ■ |
| 7 | 0 | | | | | | | | 0 | | | | | | | |
| 8 | | | | X | | | | | | | | X | | | | |
| 5 | | | | | ■ | | | | | | | | ■ | | | |
| 9 | | | | | | X | | | | | | | | X | | |
| 10 | | | 0 | | | | | | | | 0 | | | | | |
| 6 | | | | | | | ■ | | | | | | | | ■ | |
| 11 | | | | | | 0 | | | | | | | | 0 | | |
| 12 | X | | | | | | | | X | | | | | | | |
| 7 | | ■ | | | | | | | | ■ | | | | | | |
| 13 | | | X | | | | | | | | X | | | | | |
| 14 | | | | | | | | 0 | | | | | | | | 0 |
| 8 | | | | ■ | | | | | | | | ■ | | | | |
| 15 | | | | | | | | 0 | | | | | | | | 0 |
| 16 | | | | | X | | | | | | | | X | | | |

Fig. 14

| | 2 | 4 | 6 | 8 | 10 | 12 | 14 | 16 | | | | | | | | |
|---|---|---|---|---|---|---|---|---|---|---|---|---|---|---|---|---|
| 1 | ■ | | | | | | | | ■ | | | | | | | |
| 1 | | | | | | | X | | | | | | | | X | |
| 2 | | 0 | | | | | | | | 0 | | | | | | |
| 2 | | | ■ | | | | | | | | ■ | | | | | |
| 3 | | 0 | | | | | | | | 0 | | | | | | |
| 4 | | | | | | | X | | | | | | | | X | |
| 3 | | | | | | ■ | | | | | | | | ■ | | |
| 5 | | | | X | | | | | | | | X | | | | |
| 6 | 0 | | | | | | | | 0 | | | | | | | |
| 4 | | | | | | | | ■ | | | | | | | | ■ |
| 7 | 0 | | | | | | | | 0 | | | | | | | |
| 8 | | | | X | | | | | | | | X | | | | |
| 5 | | | | | ■ | | | | | | | | ■ | | | |
| 9 | | | | | | X | | | | | | | | X | | |
| 10 | | | 0 | | | | | | | | 0 | | | | | |
| 6 | | | | | | | ■ | | | | | | | | ■ | |
| 11 | | | 0 | | | | | | | | 0 | | | | | |
| 12 | | | | | | X | | | | | | | | X | | |
| 7 | | ■ | | | | | | | | ■ | | | | | | |
| 13 | | | | | X | | | | | | | | X | | | |
| 14 | | | | | | | | 0 | | | | | | | | 0 |
| 8 | | | | ■ | | | | | | | | ■ | | | | |
| 15 | | | | | | | | 0 | | | | | | | | 0 |
| 16 | | | | | X | | | | | | | | X | | | |

Fig. 16

| | 2 | 4 | 6 | 8 | 10 | 12 | 14 | 16 | | | | | | | | |
|---|---|---|---|---|---|---|---|---|---|---|---|---|---|---|---|---|
| 1 | ■ | | | | | | | | ■ | | | | | | | |
| 1 | | X | | | | | | | | X | | | | | | |
| 2 | | | | | | | 0 | 0 | | | | | | | 0 | 0 |
| 2 | | | ■ | | | | | | | | ■ | | | | | |
| 3 | | 0 | | | | | | | | 0 | | | | | | |
| 4 | | | | X | X | | | | | | | X | X | | | |
| 3 | | | | | | ■ | | | | | | | | ■ | | |
| 5 | | | | X | | | | | | | | X | | | | |
| 6 | 0 | 0 | | | | | | | 0 | 0 | | | | | | |
| 4 | | | | | | | | ■ | | | | | | | | ■ |
| 7 | | | | 0 | | | | | | | | 0 | | | | |
| 8 | | | | | | X | X | | | | | | | X | X | |
| 5 | | | | | ■ | | | | | | | | ■ | | | |
| 9 | | | | | | X | | | | | | | | X | | |
| 10 | | | 0 | 0 | | | | | | | 0 | 0 | | | | |
| 6 | | | | | | | ■ | | | | | | | | ■ | |
| 11 | | | | | | 0 | | | | | | | | 0 | | |
| 12 | X | | | | | | | X | X | | | | | | | X |
| 7 | | ■ | | | | | | | | ■ | | | | | | |
| 13 | | | | | | | | X | | | | | | | | X |
| 14 | | | | | 0 | 0 | | | | | | | 0 | 0 | | |
| 8 | | | | ■ | | | | | | | | ■ | | | | |
| 15 | | | | | | | | 0 | | | | | | | | 0 |
| 16 | | X | X | | | | | | | X | X | | | | | |

FORMING FABRIC FOR A MACHINE FOR THE PRODUCTION OF WEB MATERIAL, ESPECIALLY PAPER OR CARDBOARD

CROSS REFERENCE TO RELATED APPLICATIONS

This is a continuation of PCT application No. PCT/EP2007/050486, entitled "FABRIC BELT FOR A MACHINE FOR PRODUCING WEB MATERIAL, ESPECIALLY PAPER OR CARD", filed Jan. 18, 2007, which is incorporated herein by reference.

BACKGROUND OF THE INVENTION

1. Field of the Invention

The present invention relates to a forming fabric for a machine for the production of web material, especially paper or cardboard.

2. Description of the Related Art

A forming fabric of this type which consists of two fabric layers and which is generally also referred to as a forming wire is known from US 2004/0149342. A web-side first fabric layer carries the material which is to be produced and is woven as a basket weave in order to minimize the risk of marking the web material which is to be produced, by providing an as smooth as possible surface on the web-side first fabric layer. A backing-side or machine-side second fabric layer provides the necessary stability to the forming fabric and travels during operation over the various rolls or roller elements which guide or drive the forming fabric. The two fabric layers are interconnected with each other by a plurality of binder threads.

What is needed in the art is a forming fabric for a machine for the production of web material which, on the one hand further reduces the tendency of marking and on the other hand also provides great stability under load.

SUMMARY OF THE INVENTION

The present invention provides a forming fabric for a machine for the production of web material, especially paper or cardboard, which includes a first fabric layer on the web material side and a second machine-side fabric layer, whereby the first fabric layer and the second fabric layer are interconnected with each other by binder threads and whereby the second fabric layer is woven in an irregular satin weave.

Utilizing an irregular satin weave for the second fabric layer offers various advantages. While a uniform satin weave results in very defined, dominant weave diagonals, that is, diagonals defined by the interlacing points of the warp and weft threads which carry the risk that they mark through the material-side first fabric layer, an irregular satin weave ensures that such dominant diagonals cannot occur. Nevertheless, the irregular satin weave self-evidently also considers the fundamental standard rules for the formation of a satin weave, for example that no interlacing point adjoins another interlacing point. An additional advantage in utilizing a satin weave is that this offers a very high ratio of floating to the interlacing points. This means the individual involved threads extend through the fabric mostly without forming interlacing points. On the one hand this contributes to a reduction in the tendency of marking, but ensures on the other hand that, for example such threads are primarily present on the backing-side which have been created to meet the demands occurring there.

An especially advantageous design form may provide that the irregular satin weave is an irregular 8-thread satin weave. The utilization of such an irregular 8-thread satin weave results in that on the one hand still comparatively long floating threads remain, that however on the other hand these floating threads are not so long as to create a risk that individual threads are moved due to the forces occurring during the production process.

In addition the inventive forming fabric may be designed so that the first fabric layer and the second fabric layer are constructed with longitudinal threads extending in a longitudinal direction of the forming fabric and with cross threads extending in cross direction of the forming fabric and that the floating of the cross threads of the second fabric layer extends on the side of the longitudinal threads of the second fabric layer, facing away from the first fabric layer.

This structure results in that primarily the cross threads form the backside- or machine-side surface and, accordingly thread material which is highly wear-resistant can therefore be selected for this application. The longitudinal threads of the second fabric layer can then be selected essentially to be unaffected by any wear requirements, so that they provide the forming fabric with a special tensile strength.

Because of technological manufacturing reasons it may be advantageously provided that the longitudinal threads are warp threads and the cross threads are weft threads.

A design variation which is advantageous for avoiding marking in the web material which is to be produced may provide that in a pattern repeat of the second fabric layer the interlacing points which are formed between longitudinal threads and cross threads are distributed such that at least two groups having three interlacing points exist, with a distance that corresponds to a counter of 2 or a progressive number of 2. This results in the provision of a relatively large number of interlacing points in comparatively small areas so that roughly the same conditions are produced as are present in a 5-thread satin. Interlacing points that are located very closely to each other are also advantageous for reducing the marking tendency. There are then fewer interlacing points in other areas, so that an essentially smooth surface is provided there.

An alternative design variation may provide that in a pattern repeat of the second fabric layer the interlacing points which are formed between longitudinal threads and cross threads are distributed such that at least one group having 5 interlacing points exists, with a distance relative to each other corresponding to a counter of 2 or a progressive number of 2. The design may also provide that in addition at least one group with three interlacing points exists in the pattern repeat, with a distance relative to each other corresponding to a counter of 2 or a progressive number of 2.

An additional advantageous design variation may provide that in a pattern repeat of the second fabric layer the interlacing points which are formed between longitudinal threads and cross threads are distributed such that at least one group having four interlacing points exists, with a distance relative to each other corresponding to a counter of 2 or a progressive number.

In order to achieve a very stable interconnection between the two fabric layers and also to reduce the risk of marking the web material which is to be produced by introduction of the binder threads it is suggested that the binder threads form binder thread pairs, whereby each binder thread pair in longitudinal direction or in cross direction respectively extends between two threads of the first fabric layer and two threads of the second fabric layer.

It is preferable that always one binder thread of a binder thread pair interconnects with threads of the first fabric layer, while the other binder thread of this binder thread pair interconnects with at least one thread of the second fabric layer and that the two binder threads of the binder thread pair change over at a crossing point, so that the other binder thread interconnects with threads in the first fabric layer, while the one binder thread interconnects with at least one thread in the second fabric layer.

The crossing points of adjoining binder thread pairs may form a uniform crossing point pattern. It is further suggested that in the case of two immediately adjoining binder thread pairs no binder thread should interconnect with the same thread of the second fabric layer.

In order to avoid detrimental effects which are caused by an excessive disorder or asymmetry in the forming fabric it is suggested that at least some of the interlacing points which are formed between the binder threads and the threads of the second fabric layer form a uniform interlacing point pattern.

An advantageous design form may further provide that no binder thread interconnects with a thread of the second fabric layer with which a thread of the second fabric layer, running immediately adjacent to this binder thread, interconnects. In this way it can be avoided that a binder thread interconnects with a thread of the second fabric layer which, due to its immediately adjacent interconnection with an additional thread from the second fabric layer is heavily curved, so that a binder thread interconnecting at that location could be pushed sideward due to the presence of the curvature.

An alternative design variation of the inventive forming fabric suggests that an irregular satin weave is an irregular 6-thread satin weave. This too offers the fundamental advantage that, because of the irregularity in the satin weave, no weave diagonals occur which would become visible in the first fabric layer, thereby creating the risk of marking the web material, for example the paper that is to be produced.

In this type of design it is also advantageous if the first fabric layer and the second fabric layer are composed with longitudinal threads extending in an longitudinal direction of the forming fabric and cross threads extending in a cross direction of the forming fabric, and if the floating of the cross threads of the second fabric layer extends on the side on which the longitudinal threads of the second fabric layer are facing away from the first fabric layer.

The longitudinal threads may be warp threads and the cross threads may be weft threads.

In addition the inventive forming fabric may be structured such that the longitudinal threads of the second fabric layer extending in a longitudinal direction of the forming fabric and/or the cross threads of the second fabric layer extending in a cross direction of the forming fabric are arranged at an essentially uniform distance from each other.

Alternatively it is possible that the longitudinal threads of the second fabric layer extending in a longitudinal direction of the forming fabric and/or the cross threads of the second fabric layer extending in a cross direction of the forming fabric are grouped in pairs, whereby the distance of the threads within a respective pair is less than the distance between a pair and a thread adjoining that pair. In this kind of embodiment of the forming fabric which, due to the uneven distribution of the longitudinal threads and the cross threads of the second fabric layer could be considered as being disadvantageous, this grouping into thread pairs can be utilized in an especially advantageous way if a weft ratio and/or a warp ratio of 2:3 exists between the first fabric layer and the second fabric layer. This means that in each case two threads, for example warp threads of the first fabric layer are allocated to three threads of the second fabric layer. If it is then further ensured that a thread of the first fabric layer extends over a space between one pair and a thread of the second fabric layer adjoining said pair, the relative position of the respective threads of the first fabric layer and the second fabric layer is selected such that the two fabric layers can be positioned very closely to each other, resulting in a very thin forming fabric.

In addition the grouping into thread pairs can be advantageously utilized if a weft ratio and/or a warp ratio of 3:3 exists between the first fabric layer and the second fabric layer. This situation may provide that, in a space between one pair and a thread of the second fabric layer a thread adjacent to said pair a binder thread providing the interconnection between the first fabric layer and the second fabric layer is tied into second fabric layer.

By incorporating such a binder thread which provides the interconnection with the second fabric layer at a point where there is a somewhat greater distance between the thread pairs an especially advantageous structure with regard to the dewatering marking is achieved.

The current invention further relates to a method for the production of a forming fabric for a machine for the production of web material, specifically paper or cardboard, whereby in said method the forming fabric is woven with a first fabric layer facing the web material side and a second machine-side fabric layer, whereby the first fabric layer and the second fabric layer are interconnected with each other by binder threads and whereby the second fabric layer is woven in an irregular satin weave.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 3 is a view according to FIG. 1, which depicts the interlacing points of the backing-side fabric layer and also the interlacing points of binder threads occurring in the backing-side fabric layer;

FIG. 4 is a depiction according to FIG. 1 of an alternative arrangement.

FIG. 6 is a depiction of the arrangement illustrated in FIGS. 4 and 5, according to FIG. 3;

FIG. 7 is an additional depiction of an alternative arrangement, according to FIG. 1

FIG. 9 is a depiction of the arrangement illustrated in FIGS. 7 and 8, according to FIG. 3;

FIG. 12 is a depiction of the arrangement illustrated in FIGS. 10 and 11, according to FIG. 3;

FIG. 14 is a depiction of the arrangement illustrated in FIG. 13, according to FIG. 3;

FIG. 16 is a depiction of the arrangement illustrated in FIG. 15, according to FIG. 3;

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
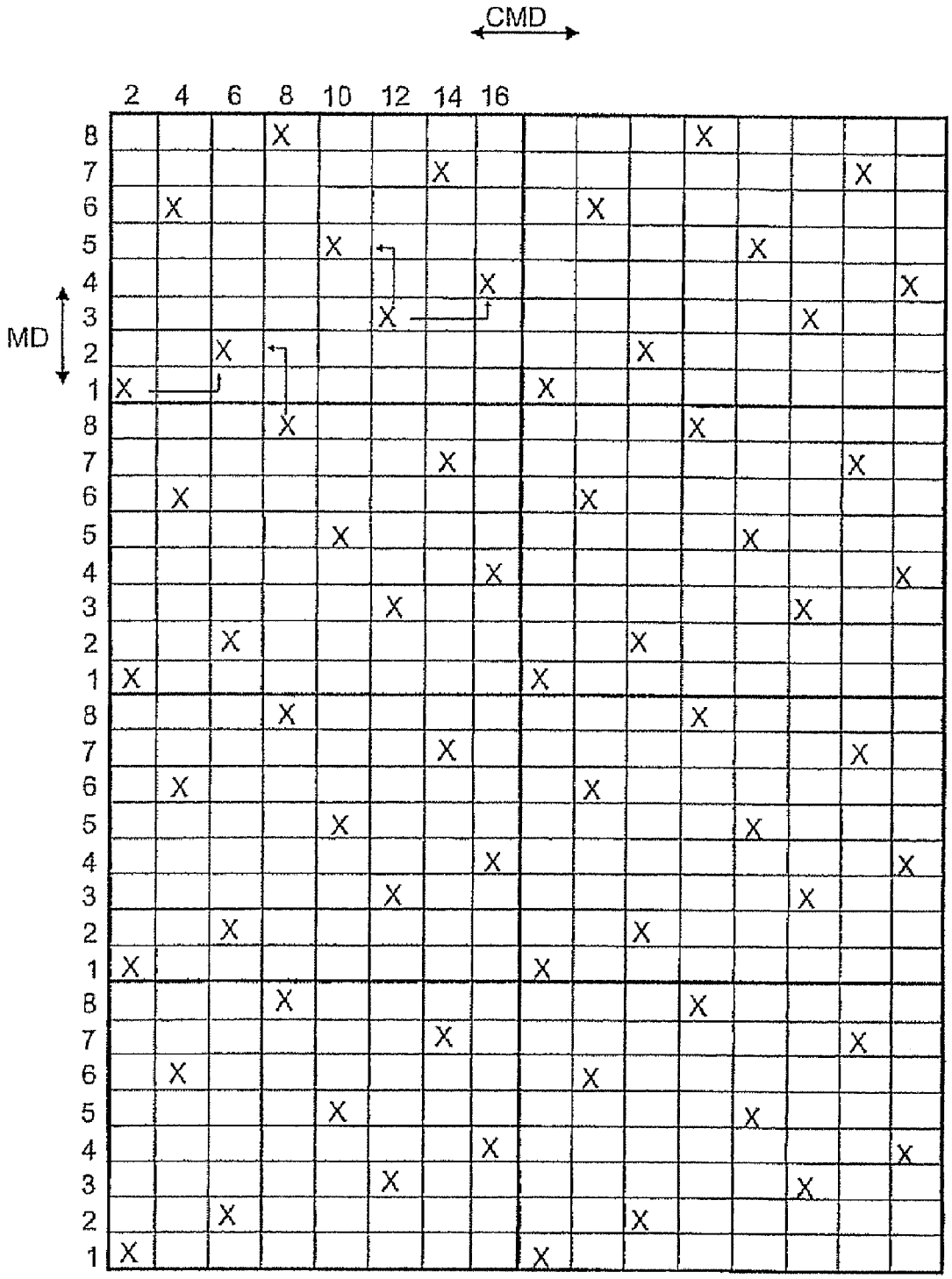
FIG. 1 is a weave pattern of a backing- or machine-side second fabric layer of an inventive forming fabric, containing a plurality of pattern repeats.
Figure 2:
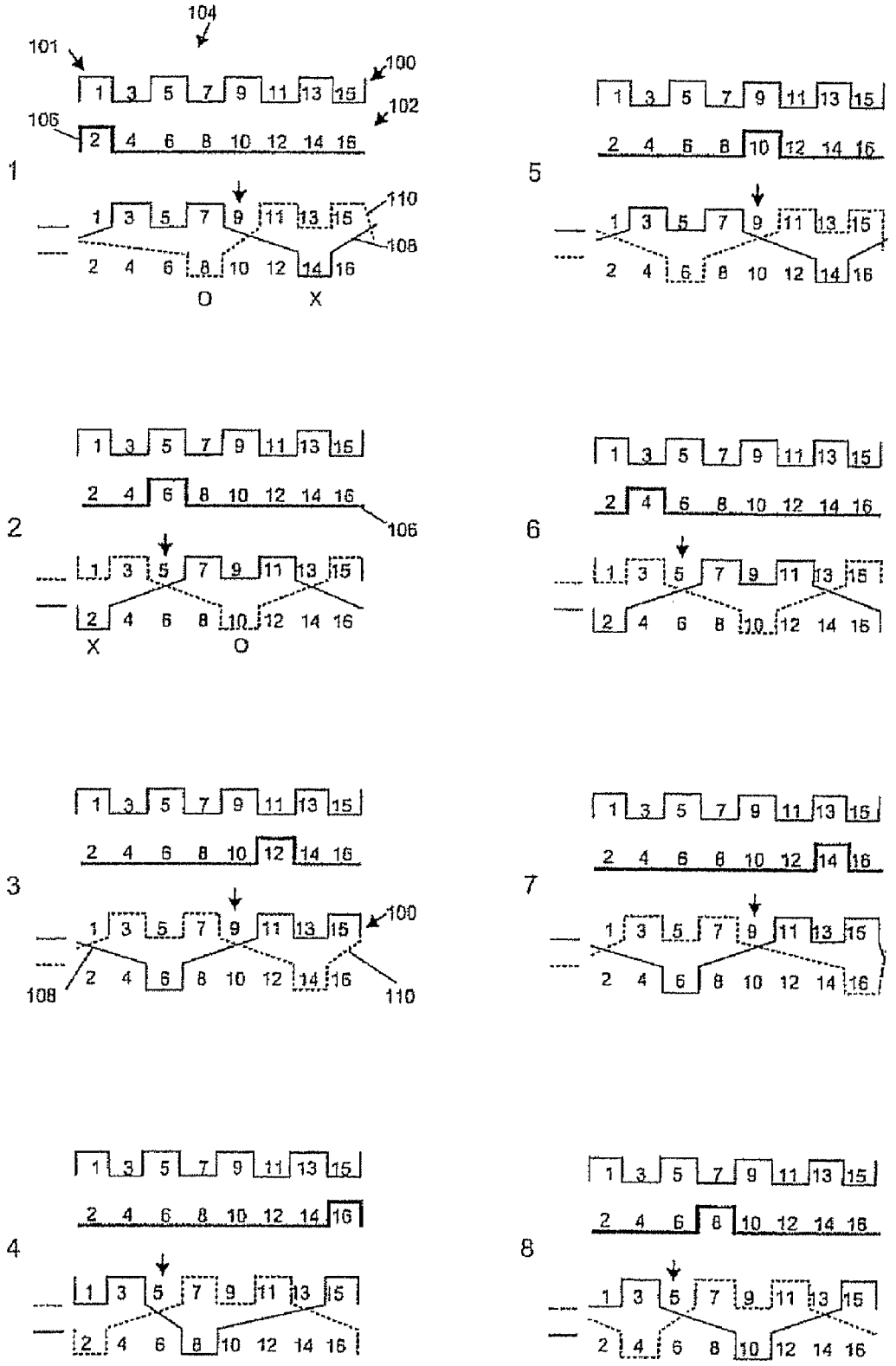
FIG. 2 is a sectional view of a pattern repeat of the weave design depicted in FIG. 1, which represents the eight thread groups occurring in the pattern repeat.

Referring now to the drawings, and more particularly to FIGS. 1 through 3, there is shown a first design form of an inventive forming fabric 101, which can be utilized especially as a forming wire in machines for the production of paper or cardboard material. This forming fabric 101 is composed of two fabric layers, namely one top, web-side first material layer 100, as shown in FIG. 2 and a bottom, backing-side or machine-side second fabric layer 102. The first fabric layer 100 provides the surface with which the finished web material comes into contact. The second fabric layer 102 represents the back side of the forming fabric on which said forming fabric travels over the various guide and drive rollers.

FIG. 1 illustrates a weave pattern of the second fabric layer 102 over a distance of several pattern repeats. Each of these extend over eight longitudinal threads extending in machine direction MD, accordingly generally in longitudinal direction of the forming fabric 101 and eight cross threads extending in cross direction CMD. The following assumes that the threads extending in longitudinal direction, or machine direction MD are warp threads in the manufacturing process, while the threads extending in cross direction CMD are weft threads. FIG. 2 illustrates the eight weft thread groups 1 through 8 of a pattern repeat and their interaction with the warp threads 1 through 16 of the same repeat. Of these warp threads the unevenly numbered warp threads 1, 3, 5 7, 9, 11, 13, 15 extend along the first fabric layer 100, while the evenly numbered warp threads 2, 4, 6, 8, 10, 12, 14, 16 extend along the second fabric layer 102.

In the example illustrated in FIGS. 1 and 2 each thread group 1 through 8 for the first fabric layer 100 and the second fabric layer 102 includes a weft thread 104 or 106 respectively, as well as a pair of binder threads 108, 110. These binder threads 108, 110 produce a solid interconnection between the two fabric layers 100, 102.

In addition, each square of a pattern repeat in FIG. 1 represents a crossing point of one of the warp threads 2 through 16 with the corresponding weft thread 106. If an "X" is shown in one of the squares, then an interlacing point is also created at this crossing point at which a weft thread interconnects above the respectively assigned warp thread. In those boxes which are not marked "X" the weft threads 106 extend under the warp threads 2 through 16 of the second fabric layer 102. They therefore run on the side facing away from the first fabric layer 100. Each "X" therefore represents a so-called warp lowering in the second fabric layer 102.

Similar to FIG. 1, FIG. 3 shows pattern repeats in the second fabric layer 102. This not only shows the interlacing points of the weft threads 106 with the warp threads 2 through 16 of the second fabric layer 102 by marking respective squares, but also illustrates the interlacing points of the binder threads 108 and 110 in the second fabric layer 102.

In FIG. 3 each black square represents an interlacing point of a weft thread 106 with one of the respective warp threads—in other words a warp lowering. The squares marked "O", as also illustrated in FIG. 2 for the thread group 1, represent an interlacing point of a respective binder thread 110 with a warp thread 2 through 16 of the second fabric layer 102, while the squares marked "X" indicate an interlacing point of the binder thread 108 with one of the respective warp threads 2 through 16 of the second fabric layer 102. An interlacing point of a respective binder thread 108 or 110 with a warp thread 2 through 16 of the second fabric layer 102 is always formed when the binder thread 108 or 110 interconnects on the outside of the involved warp thread 2 through 16, thereby representing a warp lift relative to the respective binder thread 108 or 110.

The first design arrangement depicted in FIGS. 2 and 3 shows that the weave pattern selected for the second fabric layer 102 is an irregular 8-thread satin weave. In other words, a weave where the repeat pattern extends over eight weft threads and over the same number of warp threads of the observed fabric layer. For example it can be seen from the pattern repeat which is shown top left in FIG. 1 and which extends over the thread groups 1 through 8 and the warp threads 2 through 16 that, as is required in a satin weave, none of the interlacing points created in successive thread groups in warp direction are located immediately adjacent to the interlacing points in neighboring thread groups. There is always at least one thread group or at least one warp thread in warp direction or in weft direction between two crossing points. As shown by the eight recognizable thread groups 1 through 8 in FIG. 2, the weft threads 106 extend there where they do not interconnect with warp threads. In other words, where there is no warp lowering, on the outside of the forming fabric 101, which is on the side of the second fabric layer 102 facing away from the first fabric layer 100. At this point floating occurs always over 7 warp threads of the second fabric layer 102 resulting in that almost the entire backing-side surface is provided through the weft threads 106. Only at those locations where weft threads 106 interconnect with respective warp threads 2 through 16, in other words at the locations of warp lowering, a segment of the involved warp thread represented by a respective interlacing point is located on the backing side surface. In the first instance this makes it possible to achieve a very high stability based on the selection of especially suitable material for the weft threads 106 with regard to abrasion resistance. At the same time the warp threads 2 through 16 of the second fabric layer 102 which are essentially not subjected to the wear and tear caused by contact with rollers or similar devices can be selected from a material which possesses a special tensile strength so that because these warp threads 2 through 16 of the second fabric layer, the inventive forming fabric 100 possesses an especially high tensile strength in longitudinal forming fabric direction MD. Like the weft threads 104 of the first fabric layer, the warp threads 1 through 15 of the first fabric layer 100 can also be selected from materials which are especially suitable for contact with the base material, or the web material that is to be produced. Specifically, it will become possible to utilize thinner threads and to weave them in a manner that in interaction of the binder threads 108, 110 which interconnect between the two weft threads 104 of the first fabric layer 100, with the warp threads 11 through 15 of the first fabric layer a basket weave is created on the web material side. As can be seen in FIG. 2 in the example for thread group 1 it must be considered in this context that each pair of binder threads 108, 110 is interwoven such that at the location where the binder thread 108 interconnects with the warp threads 1 through 15 of the first fabric layer 100 in the style of a basket weave, the other binder thread 110 produces interlacing point with the warp threads 2 through 16 of the second fabric layer 102. After a crossing point of the two binder threads 108, 110 which is located here between the two warp threads 9 and 10, the binder thread 110 together with the warp threads 1 through 15 of the first fabric layer 100 then creates a basket weave, while the warp thread 108 creates an interlacing point with one of the warp threads 2 through 16 of the second fabric layer 102. The two binder threads 108, 110 of a respective binder thread pair together, form a weave pattern in the first fabric layer 100 which is consistent with that of a single weft thread of a basket weave. The result is a very finely structured surface of a first fabric layer 100 with a multitude of support points and with an accordingly low marking tendency.

As already mentioned, the low marking tendency is further supported in that the inventive selected satin weave is irregular. Recognizable areas occur in FIG. 1 in which the interlacing points "X" of the weft threads 106 with the warp threads 2 through 16 are closer to each other while other areas occur where greater distances exist between the individual interlacing points "X". In the areas where the interlacing points are closer to each other an interlacing point density is created which is almost consistent with that of a basket weave, which overall also creates a very even surface. In the areas where there are greater distances between the interlacing points and where accordingly there is also longer floating of the weft threads 106, or the warp threads 2 through 16 there is a very smooth, almost unstructured surface. The dominant diagonals which are typical for the uniform satin weave are missing. All this results in the risk that a very uniform interlacing point pattern that is formed in the second fabric layer 102 marks through the first fabric layer 100 and into the web material which is to be produced being largely avoided. As illustrated in FIG. 1, it is especially advantageous if two groups of interlacing points in which the individual interlacing points are at a distance from each other that corresponds to a counter of 2 or a progressive number of 2 are present within a pattern repeat that extends over eight weft threads and eight binder threads of the second fabric layer 102 which, in other words represents the smallest weave pattern unit in warp direction and in weft direction. This is made apparent in FIG. 1 by the drawn in arrows. In this instance a counter of 2 means that a weft thread group is located between two interlacing points under consideration. A progressive number of 2 means that a warp thread is located between the two interlacing points under consideration. It should be pointed out that the applicable pattern repeat in FIG. 1 starts for example at the second weft thread group 8—viewed from above—and ends at the first weft thread group, when viewed from above which is identified with 7. Of course, any desired group of crossing points extending over eight weft threads 106 and warp threads of the second fabric layer 108 may be presented as a pattern repeat.

It is also clear from FIG. 2 that in the respective binder thread pairs 108, 110 of the eight successive thread groups 1 through 8 of a pattern repeat the crossing points are arranged alternately. While the first crossing point of the binder threads 108, 110 is located between the warp threads 9 and 10, the crossing point of the binder threads 108, 110 of the second thread group is located between the warp threads 5 and 6. The crossing point of the binder threads 108, 110 of the third thread group 3 is again between the warp threads 9 and 10, while the crossing point of the binder threads 108, 110 of the fourth thread group is again between the warp threads 5 and 6. In this manner a very symmetric interconnection is achieved between the two fabric layers 108, 110 so that no fundamental forces causing a sideway distortion of the fabric layers relative to each other can occur. At the same time an evenness overriding the irregularities of the interlacing points of the weft threads 106 with the warp threads 2 through 16 is achieved which is especially advantageous with regard to reducing the marking tendency.

In addition there is generally the desire to arrange the interlacing point of a respective binder thread 108 or 110 in the second fabric layer 102 symmetrically relative to the interlacing points of the other one of these binder threads in the first fabric layer. This is depicted in the example of the thread group 3. In this example the dotted line of interlacing thread 110 interconnects above the warp threads 3 and 7 of the first fabric layer 100. Allocated to this, the binder thread 108 shown as a solid line interconnects symmetrically relative to these interlacing points below the warp thread 6 of the second fabric layer 102. At the points where this binder thread 108 then interconnects above the warp threads 11 and 15 of the first fabric layer 100, the binder thread 110 interconnects symmetrically to it below the warp thread 14 of the second fabric layer 102. As indicated for example through the two weft thread groups 1 and 2 this standard is interrupted only at locations where a binder thread in the second fabric layer 102 might have an interlacing point which is immediately adjacent to an interlacing point of a weft thread 106 with the same warp thread in the second fabric layer 102. In order to achieve the aforementioned advantageous symmetrical appearance the binder thread 110 of the first thread group 1 would have to interconnect below the warp thread 6 of the second fabric layer 102, and not under the warp thread 8. However, the immediately adjoining weft thread 106 of the second fabric layer interconnects with this warp thread 6. This interlacing point in the second thread group results in that the warp thread 6 is comparatively heavily curved in this local area. If the binder thread 110 of the first thread group would also interconnect with the warp thread 6, then the assigned interlacing point "O" would be in an area where the warp thread 6 is comparatively heavily curved. This could result in an undesirable displacement of the binder thread 110 in warp direction. This problem can be countered by the lateral displacement of the interlacing point to the next adjoining warp thread of the second fabric layer 102.

The weave pattern of the binder threads 108, 110 illustrated in FIG. 2 further ensures that there are no immediately adjoining interlacing points in warp direction of the respective binder threads with the same warp thread. There is always an offset of at least one warp thread. This is also clearly shown in FIG. 3 where there are no two interlacing points of the binder threads following each other in warp direction, of different immediately adjacent binder thread pairs located above each other.

However it can be seen generally that the binder threads 108, 110 also form a weave pattern with a pattern repeat that extends over eight warp threads, so that the same pattern repeat exists for the binder threads between the weft threads 106 and the warp threads 2 through 16 of the second fabric layer 102, as well as for the binder threads 108, 110. The result is that an overall pattern repeat extending over eight warp threads and over eight weft threads, or weft thread groups can be achieved for the entire forming fabric 100.

Figure 5:
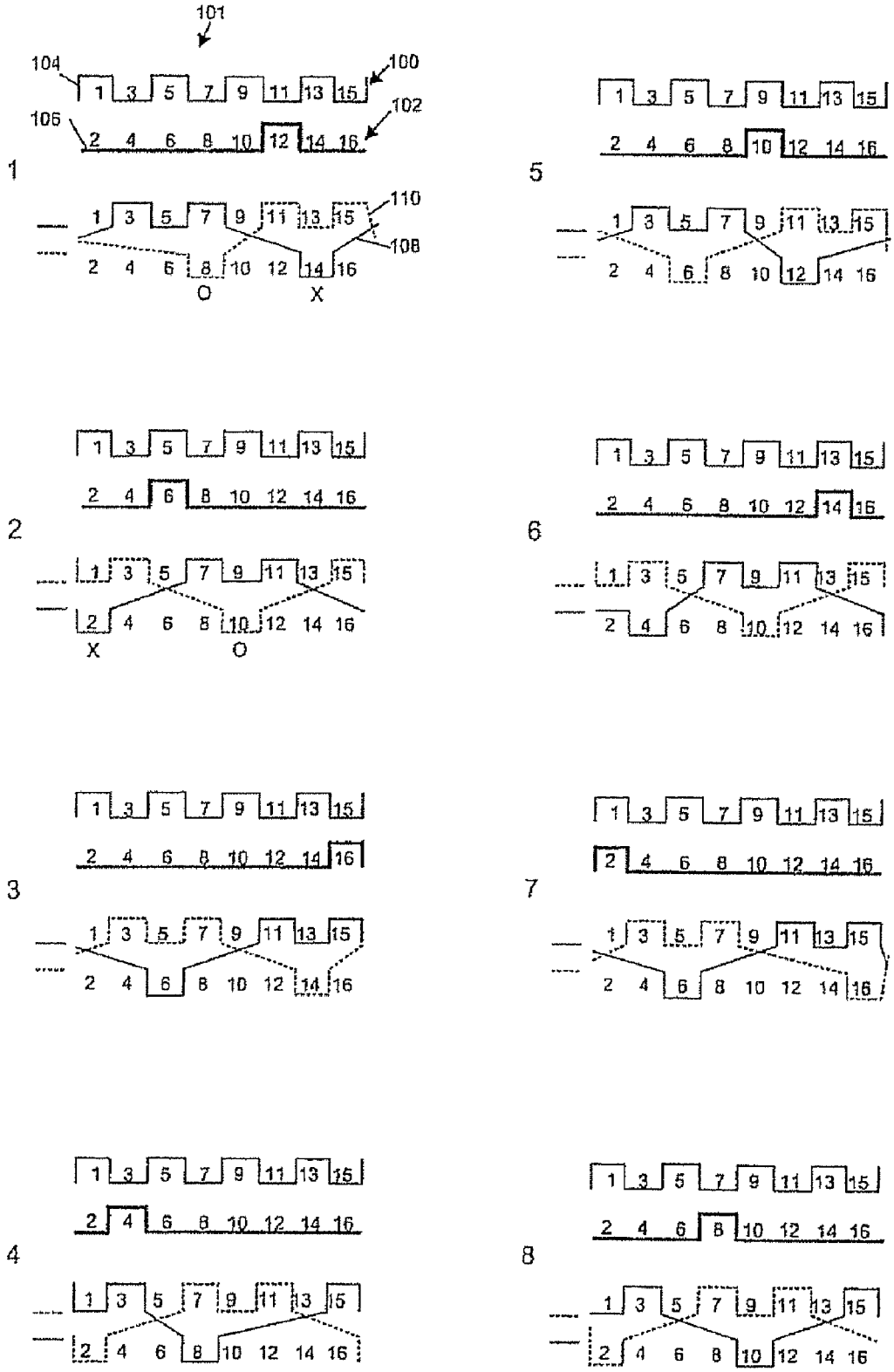
FIG. 5 is a depiction according to FIG. 2 of the arrangement illustrated in FIG. 4.

FIGS. 4 through 6 depict a design variation which also provides an irregular eight-thread satin weave for the second fabric layer 102, that is the weave pattern of the weft threads 106 with the warp threads 2 through 16 of this second fabric layer 102. However, the interlacing points are located differently than in the previously described design variation. As can be seen in FIG. 4 here for example a group of five interlacing points "X" can be in one pattern repeat, whereby the interlacing points are located from each other always relative to the counter of 2 or the progressive number of 2. An alternatively selected pattern repeat features two groups with three interlacing points each, with the counter or progressive number of 2. As in the previously described design variation there are local areas here too where for example three interlacing points occur at equal distance on a straight line. Subsequently this pattern or this uniformity is however broken again so that comparatively shorter, less dominant weave diagonals occur which are practically non-visible in the web material which is to be produced.

It can be further seen in FIGS. 5 and 6 that also in this design variation the crossing points of the two binder threads 108, 110 change regularly and that it is further attempted to position the interlacing points of a respective binder thread 108, 110 in the second fabric layer 102 symmetrically relative to the interlacing points created in this local area by the respective other binder thread in the first fabric layer 100.

In locations where this may lead to an impairment of the position of the interlacing points of a binder thread due to the interlacing points of the weft threads 106 with the warp threads 2 through 16, said thread would again interconnect with an adjoining warp thread. Nevertheless it can be seen in FIG. 6 that, similar to what is shown in FIG. 3, the interlacing points "O" and "X" form an approximately uniform pattern. Namely, they are positioned near respective imaginary diagonals. In an overlay with the irregular satin weave this leads again to a very low marking tendency and first and foremost ensures a symmetrical distribution of strength in the interconnection of the two fabric layers 100, 102.

Figure 8:
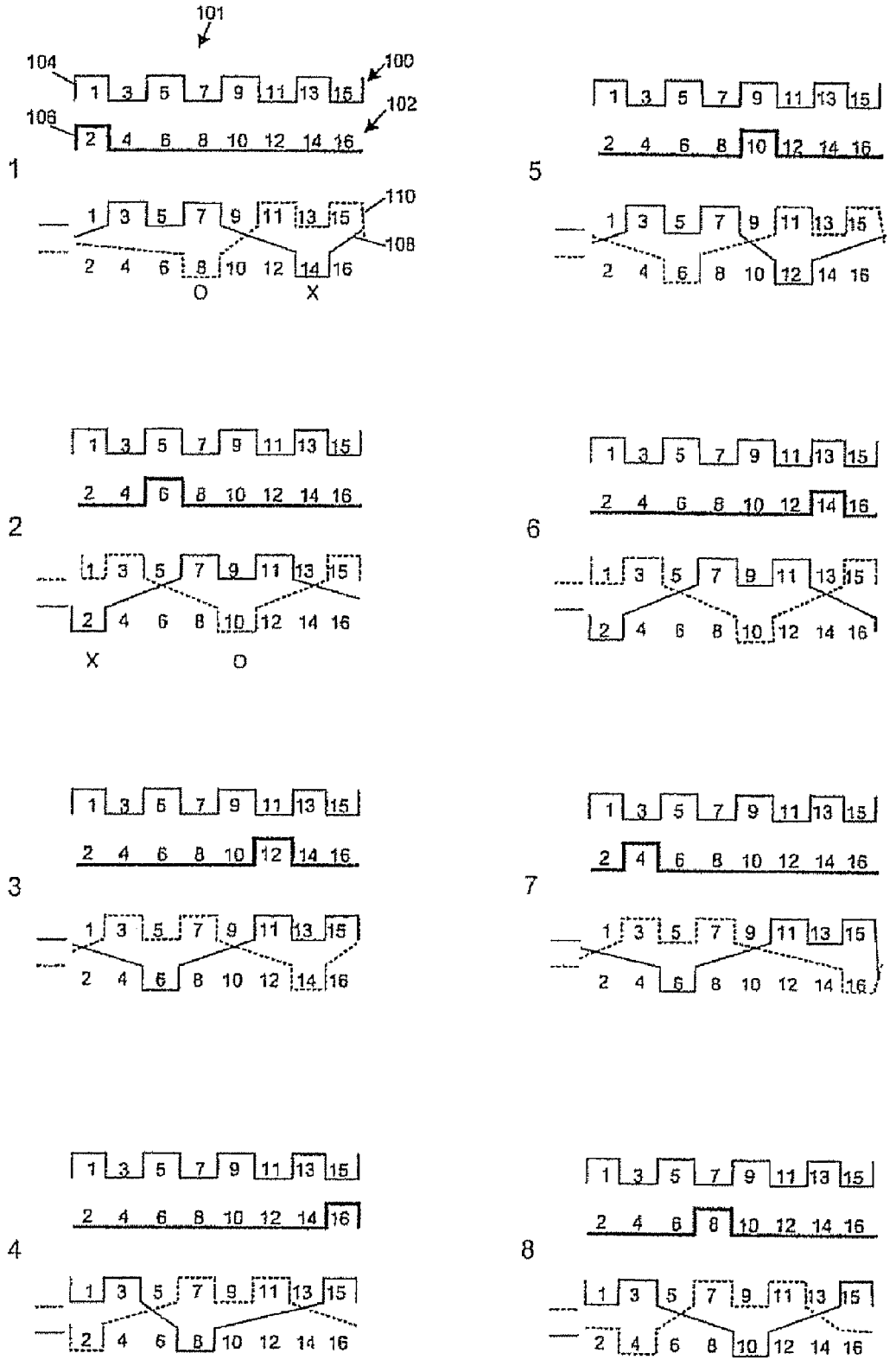
FIG. 8 is a depiction of the arrangement illustrated in FIG. 7, according to FIG. 2.

A third design variation is illustrated in FIGS. 7 through 9. In this example the weft threads 106 also interconnect with the warp threads 2 through 16 of the second fabric layer 102 in a pattern of an irregular 8-thread satin. Since however the location of the interlacing points "X" in FIG. 7 relative to the previously described design form is selected somewhat differently, local areas result in which four interlacing points "X" are positioned relative to each other such that they are at a distance of a counter 2 or progressive number 2, as indicated by the arrows in FIG. 7. These groups with always four adjoining interlacing points form stabilizing zones with reenforced warp-weft anchoring. The unevenness introduced by the irregular satin weave by avoiding dominant diagonals is overlaid by a uniformity in the arrangement of these groups of four interlacing points, with little relative distance to each other. This has proved especially advantageous with regard to reducing the marking tendency. The dominant diagonals of the uniform satin weave cannot occur, since the "diagonals" which are always defined by two interlacing points do also not yet continue in the group of 4 interlacing points which occurs in the group after the next group.

Regarding the interconnection of the binder threads 100, 102 the design variation illustrated in FIGS. 7 through 9 corresponds with the ones described previously.

Figure 10:
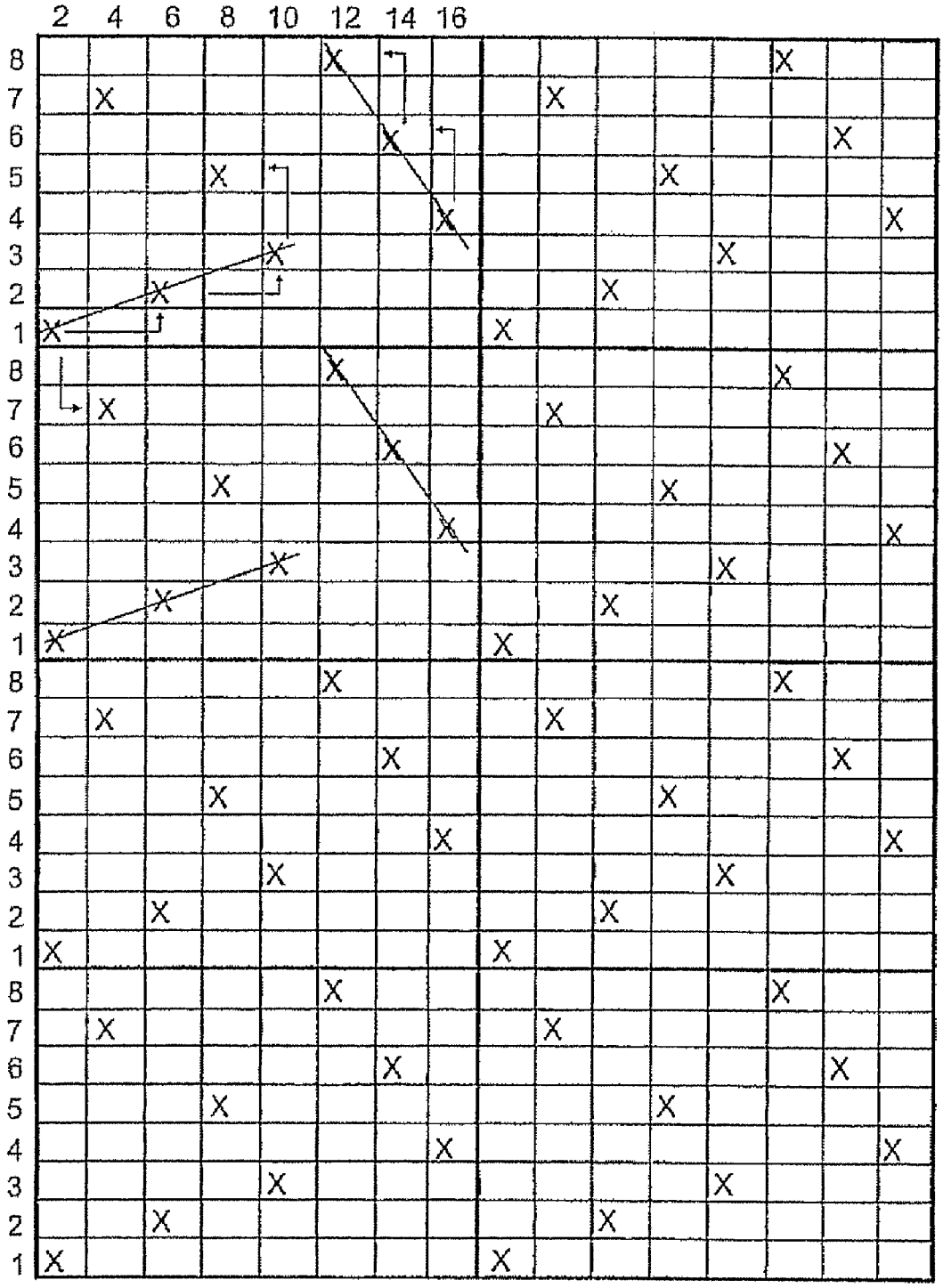
FIG. 10 is an additional depiction of an alternative arrangement, according to FIG. 1.
Figure 11:
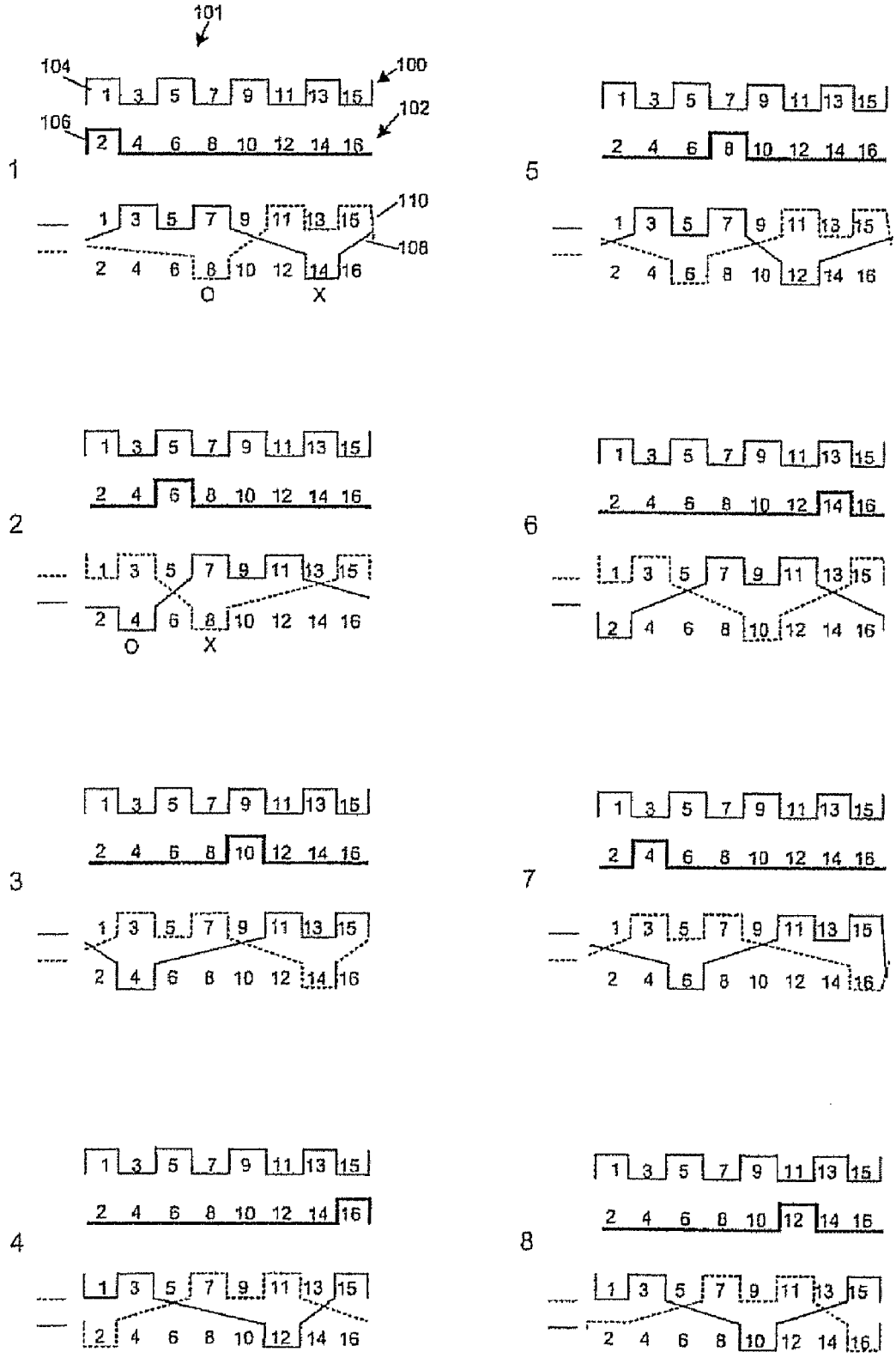
FIG. 11 is a depiction of the arrangement illustrated in FIG. 10, according to FIG. 2.

An additional alternative design variation is depicted in FIGS. 10 through 12. Here too the interlacing pattern in FIG. 10 shows an irregular 8-thread satin weave, where again two groups of interlacing points "X" are located within one pattern repeat of the second fabric layer 102 at a distance from each other of a counter of 2 or a progressive number of 2. Even though the interlacing points of each respective group are located on a straight interconnecting line, these lines are not continued in the immediately adjoining pattern repeats. Therefore, no dominant diagonals exist here either.

As explained previously, in the prior described design variations at least one weft thread is located between the interlacing points of a binder thread and a weft thread 106 with the same warp thread of the second fabric layer 102, which does not interconnect with this warp thread, in other words, it floats beneath it. In this design variation in FIG. 4 this minimum distance is defined by two such non-connecting, but instead floating weft threads 106. Otherwise the weave pattern of the binder threads 108, 110 in the design variation depicted in FIG. 10 through 12 essentially satisfies the previously described standards, whereby the crossing points of the two binder threads 107, 110 change alternatively. Also the interlacing points "O" and "X" as shown in FIG. 12 are again positioned approximately on diagonals and are arranged comparatively uniformly and are overlaid by the irregular satin weave.

With regard to the weave pattern of the weft threads 106 and the warp threads 2 through 16 of the second fabric layer 102, the additional design variations described below are arranged as depicted in FIG. 7. In order to avoid repetition, we refer you to the explanations for FIG. 7.

Figure 13:
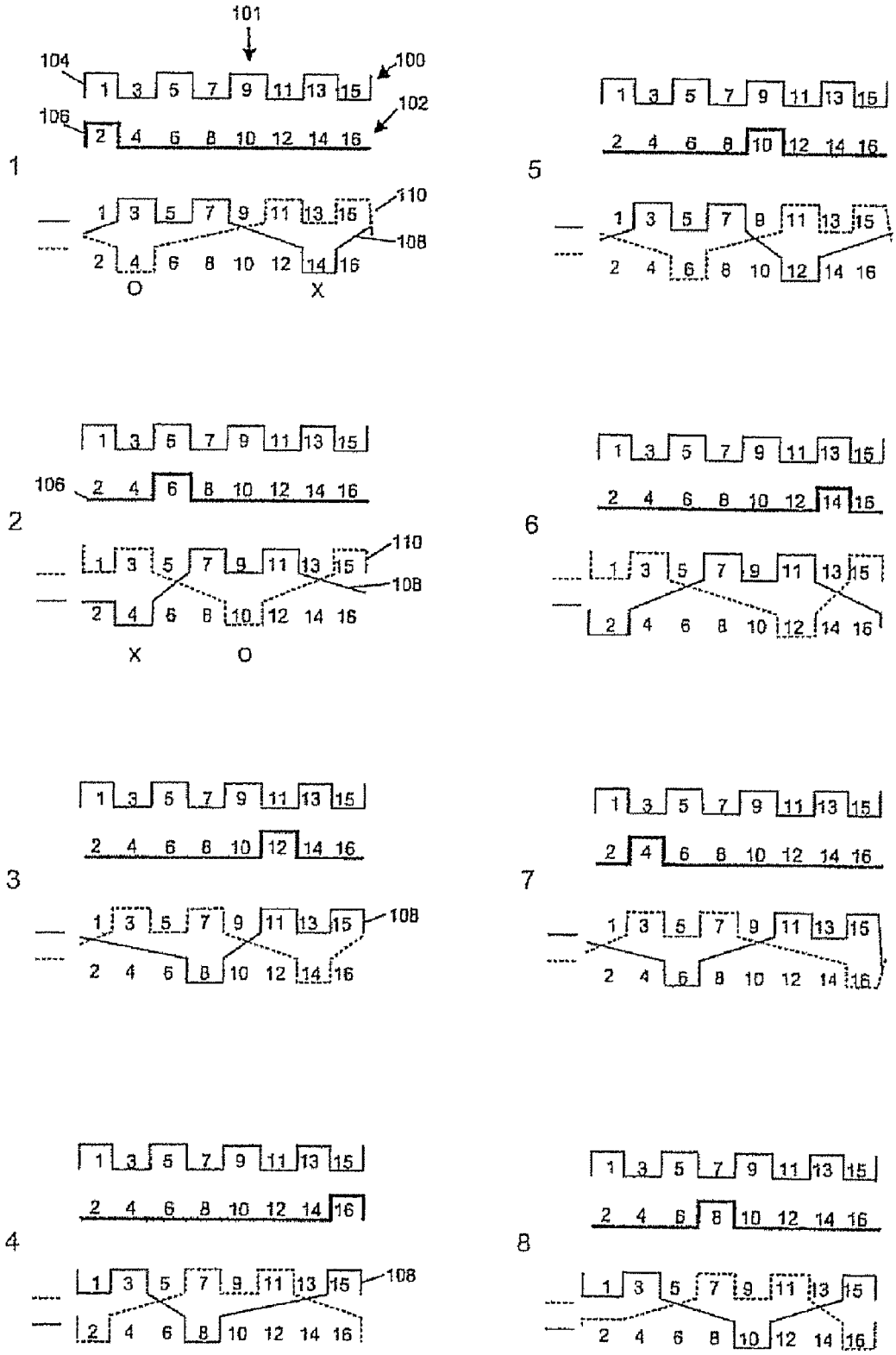
FIG. 13 is a depiction of an additional alternative arrangement, according to FIG. 2.

There is a difference in the variation depicted in FIGS. 13 and 14 with regard to the method with which the binder threads 108, 110 are interwoven. Here it is essentially provided that, within a pattern repeat not both interlacing points of the binder threads 108 and 110 in a thread group in the second fabric layer 102 are always positioned symmetrically to the interlacing points of the other binder thread in the first fabric layer 100. Originating from a symmetrical arrangement one of the interlacing points in the second fabric layer is always offset laterally by one warp thread relative to the interlacing points in the upper first fabric layer 100. An additional standard regarding the binder threads is that the distance of an interlacing point in the bottom fabric layer 102 to an interlacing point of a weft thread 106 with the same warp thread of the warp thread group 2 through 16 contains at least two such weft threads 106. In other words, between each interlacing point of a weft thread 106 with a warp thread and an interlacing point of the same warp thread with a binder thread there are at least two weft threads 106 which float beneath this warp thread.

In addition the binder threads 108, 110 satisfy the conformity that, then when one of the interlacing points in one binder thread pair in the second fabric layer 102, originating from the symmetrical positioning is laterally displaced, in this instance for example to the left (i.e. thread group 1 in FIG. 13) and when, in the next thread group for example the binder thread pair 108, 110 the non-symmetrically positioned interlacing point of a binder thread in the second fabric layer 102 is displaced to the other side, in this instance therefore to the right (thread group 2 in FIG. 13), these two observed binder threads, that is binder thread 110 of the first thread group in FIG. 13 and the binder thread 108 of the second thread group in FIG. 13 interconnect under the same warp thread, namely the warp thread 4 of the second fabric layer 102, thereby always creating an interlacing point "O" or "X", whereby a weft thread, that is weft thread 106 is located between these two interlacing points. In the immediately following group, including two pairs of binder thread pairs 108, 110 which, in the present example are the two thread groups 3 and 4—the first interlacing point of a binder thread is displaced in the other direction. This means that, in this case it is displaced to the right (binder thread 108 of the thread group 3), while the second, non-symmetrical interlacing point is also displaced in the opposite direction, in this case to the left (binder thread 108 of the thread group 4). These too will then interconnect below the same warp thread—that is the warp thread 8 of the second fabric layer. This alternating pattern then repeats itself also for the thread groups 5 through 8, so that collectively the non-centered interlacing points of the binder threads 108 or 110 in the fabric layer 102 represent an alternating left-right offset. In other words they form a uniform pattern which again, is very advantageous in superimposing with the irregular 8-thread satin weave. Contributing to this is also, as can be seen in FIG. 13, that the crossing points of the binder threads 108, 110 again display the already previously described offset. Collectively a uniformity in the arrangement of the crossing points of the binder threads and a uniformity in the arrangement of the interlacing points of the binder threads and also the deviation from the symmetrical layout of the interlacing points of the binder threads is overlaid over the irregular satin weave. These uniformities in the crossing points and the interlacing points can always be evident in that they are positioned on diagonals or exhibit an alternating offset in both directions.

Similar to FIGS. 13 and 14, FIGS. 15 and 16 show an additional alternative design variation which corresponds to the design variation depicted in FIGS. 7 through 9 with regard to the weave pattern of the second fabric layer 102. One difference is again found in the manner in which the binder threads 108, 110 are woven into the forming fabric 101. Here too, care is taken that in interconnecting these binder threads 108, 110 a uniform structure of the binder threads 108, 110 is overlaid over the irregular 8-thread satin weave.

Initially a regularity is recognized in that always two weft thread groups which are immediately following each other are identical to each other with regard to the interconnection of the binder threads 108, 110. These are the weft thread groups 1 and 2, 3 and 4, 5 and 6, 7 and 8. These pairs of binder threads 108, 110 which are arranged identical to each other are separated by a weft thread 104 of the first fabric layer 100 and a weft thread of the second fabric layer 102 respectively. It can also be seen that in the weft thread groups 1 and 2, 5 and 6 the crossing points of the binder threads 108, 110 are positioned between the warp threads 9 and 10 respectively. In the weft thread groups 3 and 4, 7 and 8 these crossing points are located between the warp threads 5 and 6. Again, this provides the alternating change of the crossing points. The interlacing points in the second fabric layer 102 are again positioned such that one of them is laterally displaced out of the symmetrical positioning relative to the interlacing points of the other binder thread in the first fabric layer 100 above it. Specifically, an offset to the same side—in this instance to the left exists with all of the thus laterally displaced interlacing points.

Figure 15:
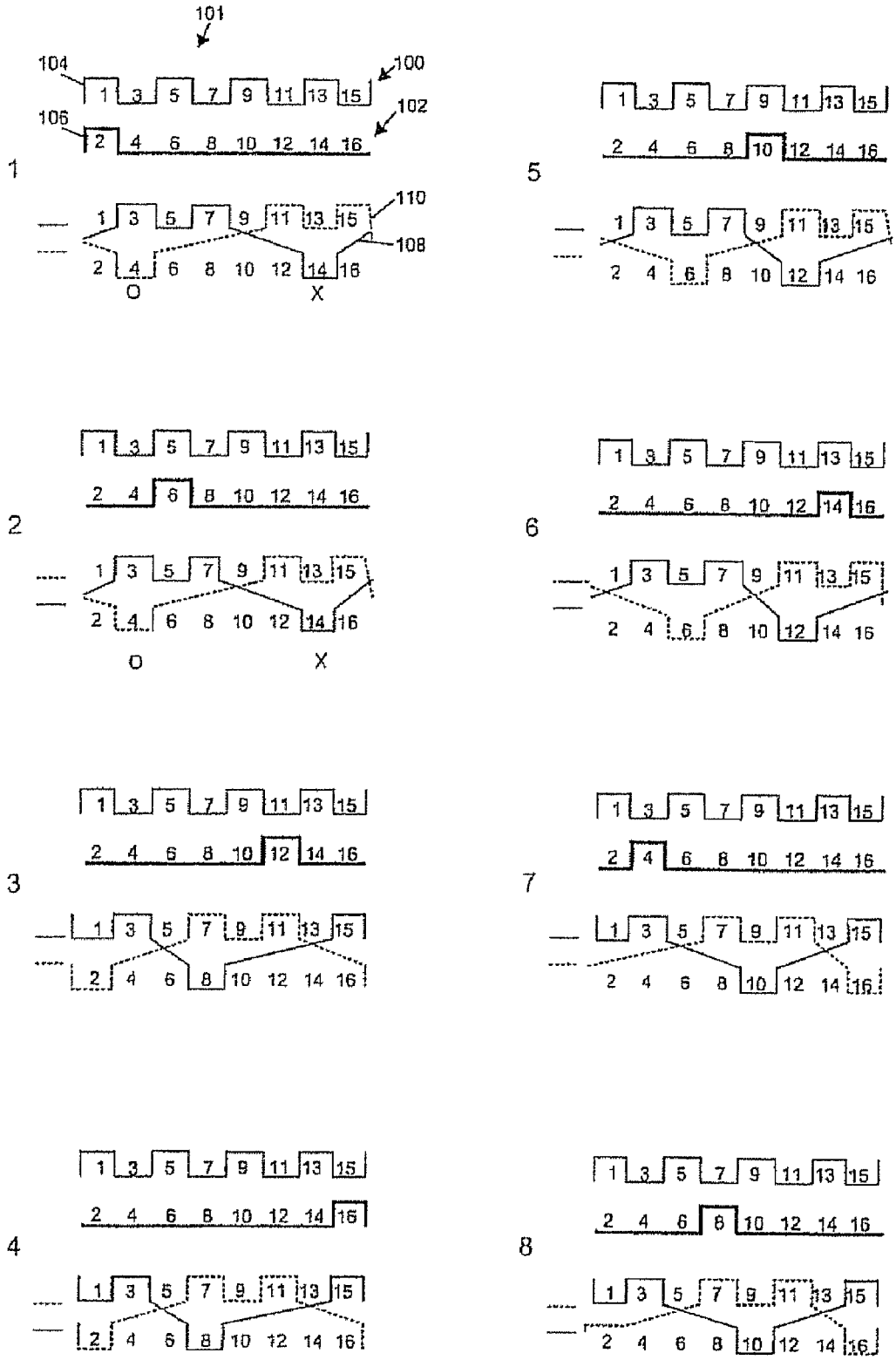
FIG. 15 is a depiction of an additional alternative arrangement, according to FIG. 2

It can further be seen in FIGS. 15 and 16 that between one interlacing point of one binder thread 108 or 110 with one warp thread 2 through 16 of the second fabric layer 102 and one interlacing point of said warp thread of the second fabric layer 102 with one weft thread 106 of the second fabric layer 102, at least two such weft threads 106 are located which do not interconnect with said warp thread and which below it float past it.

FIG. 16 also clearly shows one aspect which is or may also be provided in the other inventive design variations. In observing, for example the first thread group containing the weft thread 1 and the two binder threads 1, 2 in FIG. 16 it can be seen that, in warp direction initially the binder thread 108 follows the weft thread 106 contained in this thread group 1 of the second fabric layer 102 and forms the interlacing point "X" with the warp thread 14. Then, the binder thread 110 follows in warp direction and forms the interlacing point "O" with the warp threat 4. In the next thread group, that is thread group 2 containing the binder threads 3, 4 the binder thread 110 initially follows and forms the interlacing point "O". This is followed in warp direction by the binder thread 108 for the purpose of creating the interlacing point "X", in this instance with the warp thread 14. This means that in weft thread groups which follow each other in warp direction the weft of the binder threads changes. This has an especially advantageous result upon the surface structure of the first fabric layer 100 and helps in the avoidance of marking effects.

Figure 17:
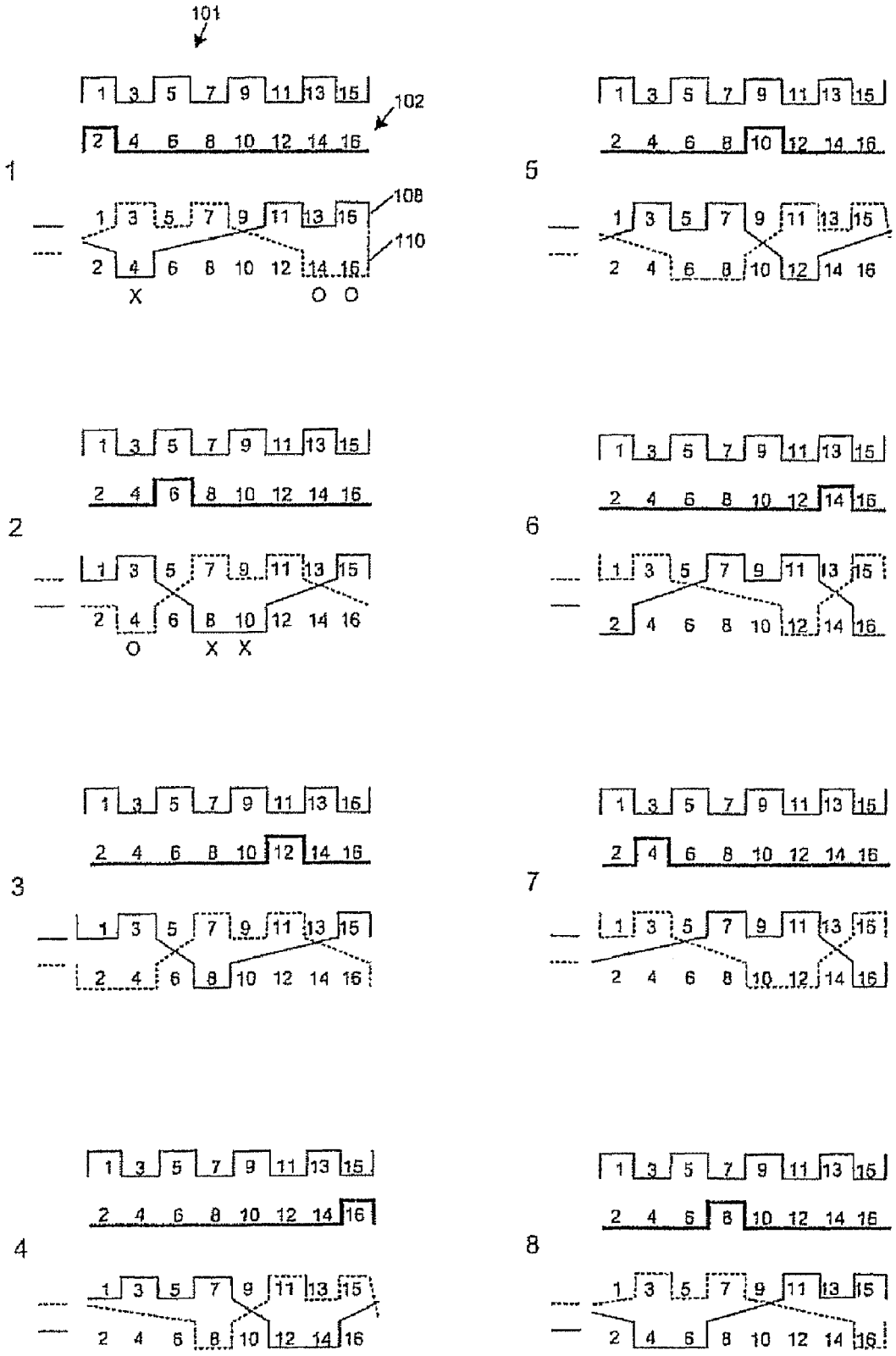
FIG. 17 is a depiction of an additional alternative arrangement, according to FIG. 2
Figures 18, 19:
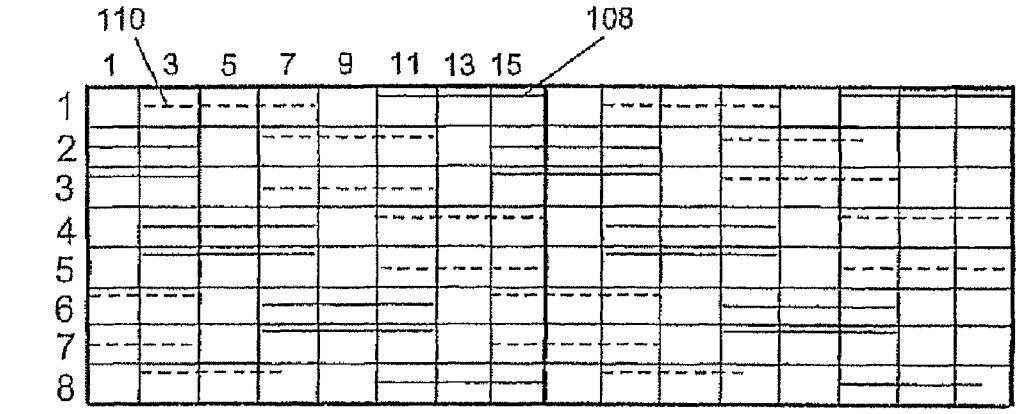
FIG. 18 is a depiction of the arrangement illustrated in FIG. 17, according to FIG. 2.
FIG. 19 is an illustration which depicts the extension of the binder threads in two adjoining pattern repeats in the web-side fabric layer.

An additional variation of a forming fabric 101 is illustrated in FIGS. 17 through 19. The weave pattern of the second fabric layer 102 illustrated here is also consistent with the one depicted in FIG. 7. A fundamental difference in the interconnection of the binder threads 108, 110 consists primarily in that, in the weft thread groups 1 through 8 the binder thread 110 and then the binder thread 108 in the bottom fabric layer 102 alternate in interconnecting with two immediately adjoining warp threads of the bottom fabric layer 102. In this way the overall weave structure is further strengthened. It can be seem, especially in FIGS. 17 and 18 that the location of these double interlacing points "OO" and "XX" is selected so that a uniformity in the arrangement is achieved in as far as diagonal lines are formed on which these double interlacing points are located. The single interlacing points of the binder threads 108, 110 in the second fabric layer are also selected so that they are located on diagonals. This results in a very uniform distribution, also for the sections of these binder threads 108, 110 which form a basket weave in the first fabric layer as shown in FIG. 19. Of the weft thread groups 1 through 8 the binder thread section of the binder threads 108, 110 are shown as they are represented on the surface of the first fabric layer 100. It can be seen that a progressive diagonal pattern is achieved for the individual segments of the two binder threads 108, 110. This means the segments of these binder threads 108, 110 which form a basket weave in the first fabric layer are generally arranged so that an offset always results in warp direction, whereby for example two adjacent binder threads 108 or 110 respectively of adjoining weft thread groups are interconnected identically and therefore do not display a lateral offset in weft direction. This offset, or paired offset of the segments of the binder threads 108, 110 in the first fabric layer 100 forming the basket weave is also contributory in that a weave pattern with greater uniformity is overlaid over the irregular weave pattern of the 8-thread uneven satin of the bottom, second fabric layer 102.

Figure 20:
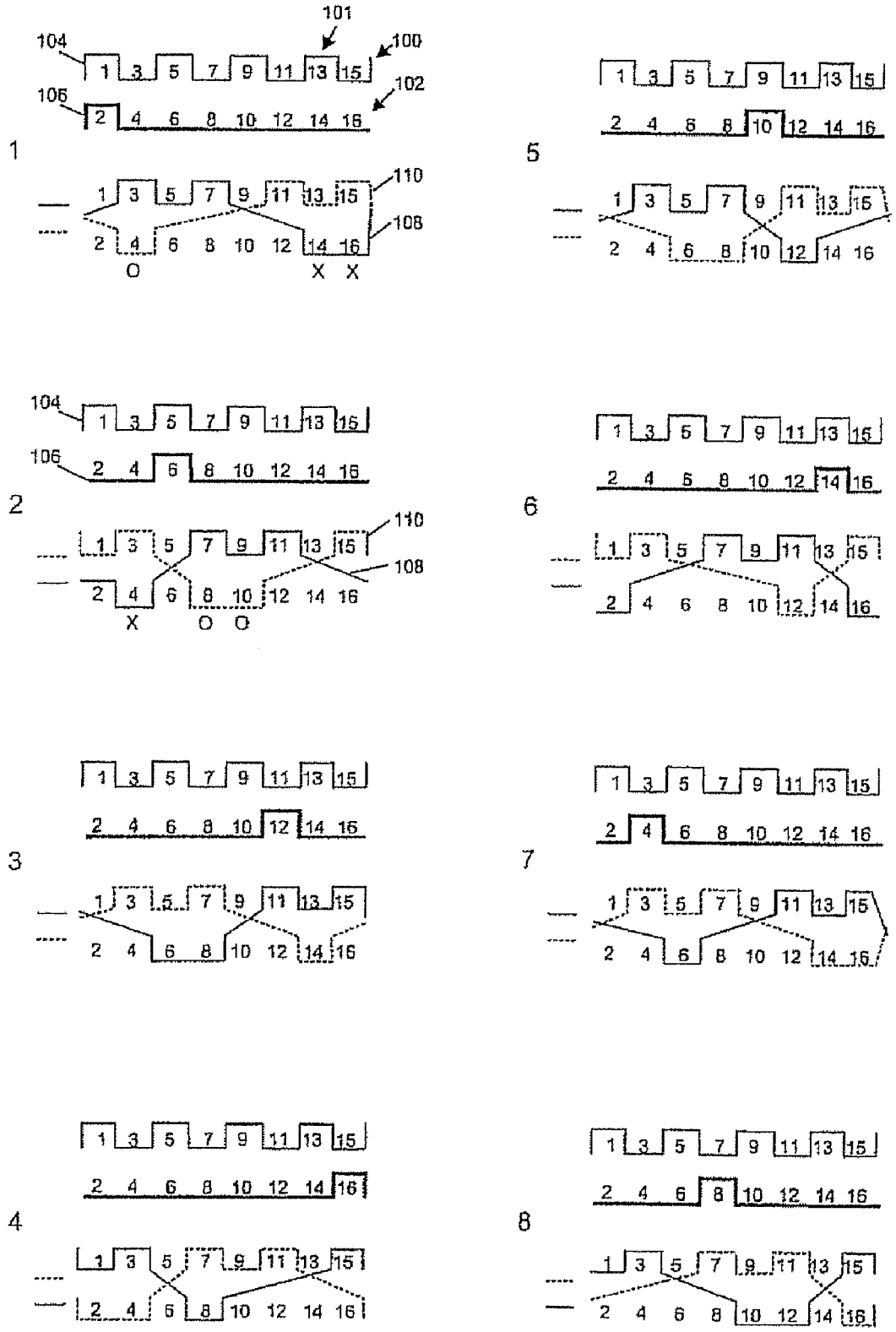
FIG. 20 is a depiction of an additional alternative arrangement, according to FIG. 2.
Figure 21:
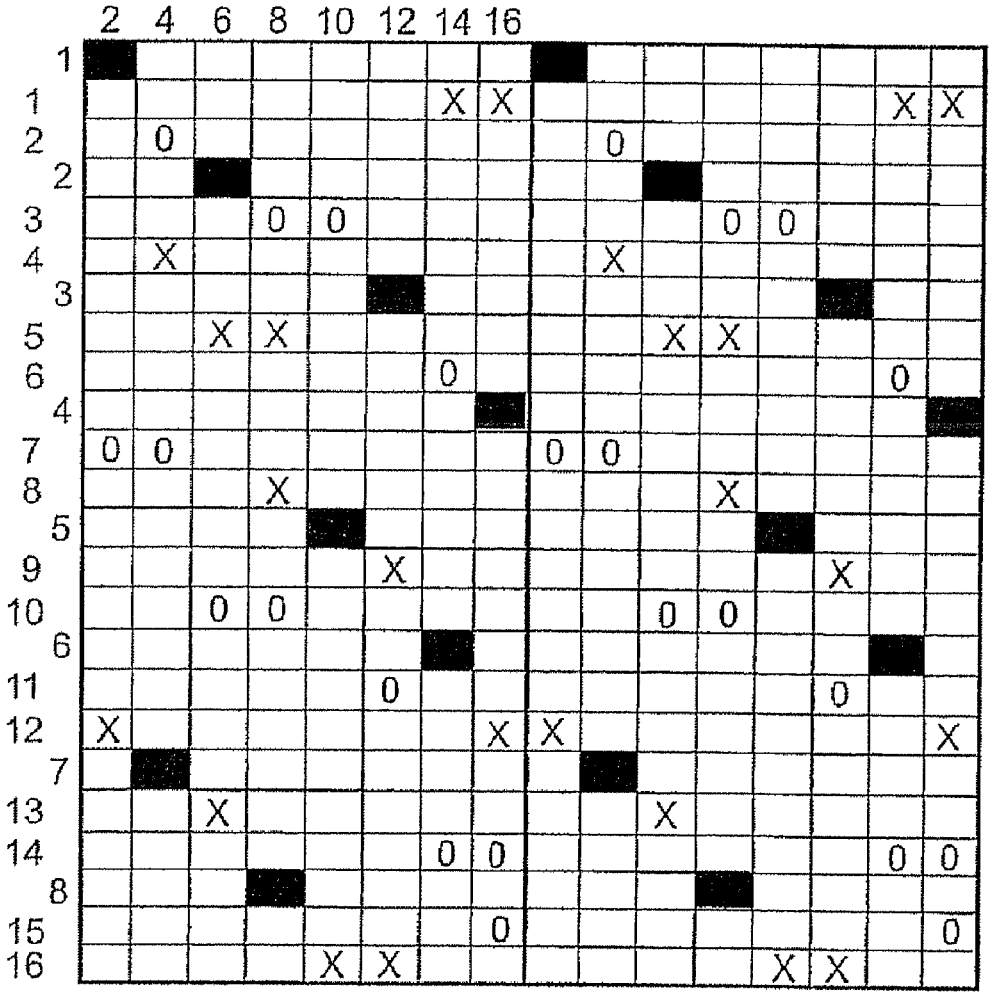
FIG. 21 is a depiction of the arrangement illustrated in FIG. 20, according to FIG. 3.
Figure 22:
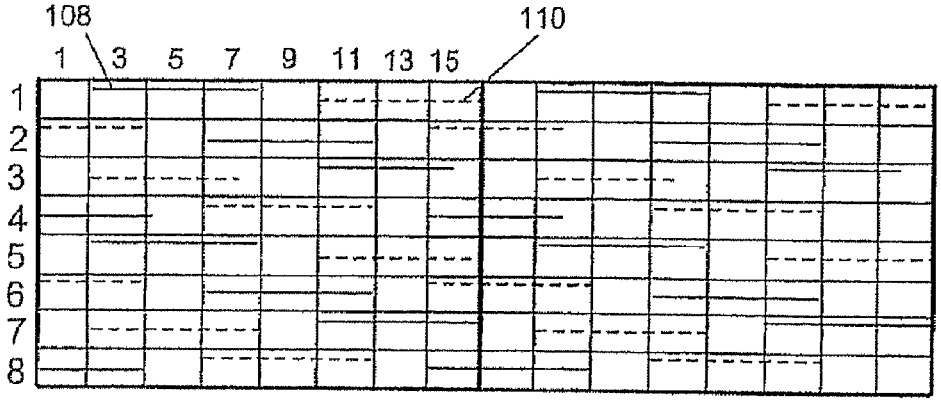
FIG. 22 is a depiction of the arrangement illustrated in FIGS. 20 and 21, according to FIG. 19.

FIGS. 20 through 22 show a variation which is approximately consistent with the design variation described in reference to FIGS. 17 through 19. Here too, the binder threads 108, 100 respectively interconnect alternatively with two warp threads of the second fabric layer. In the interconnection depicted in FIG. 20 the crossing points of adjoining weft thread groups again alternate. Therefore, they are located one time between the warp threads 9 and 10 and one time between the warp threads 5 and 6. This, combined with the double interlacing points of one binder thread 108 or 110 respectively results in the pattern depicted in FIG. 22 where in adjoining weft thread groups respective identical binder threads, together with their segments which form a basket weave in the first fabric layer 100 show a progressive offset in weft direction.

Previously, with reference to FIGS. 1 through 22 weave patterns were described which are woven in a so-called 2:1 weft ratio. This means that one weft thread from the second fabric layer 102 combines with two weft threads in the first fabric layer 100. For example, this is clarified in FIG. 20 and the weft thread groups 1 and 2. Here, the first fabric layer contains the weft thread 104 of the first weft thread group 1, the "weft thread" which is formed by the two segments of the binder threads 108, 110 which form the basket weave, the weft thread 104 of the second weft thread group and the "weft thread" which is formed by the two segments of the binder threads 108, 110 of the second weft thread group 2 which form the basket weave. The first fabric layer 100 therefore contains a total of four "weft threads", while the second fabric layer 102 contains only the two weft threads 106 of the two weft thread groups 1 and 2. This corresponds to a ratio of 4:2, consequently 2:1 which is considered to be especially advantageous due to the comparatively high quota of weft threads in the first fabric layer, that being the fabric layer providing the support for the web material which is to be produced.

Figure 23:
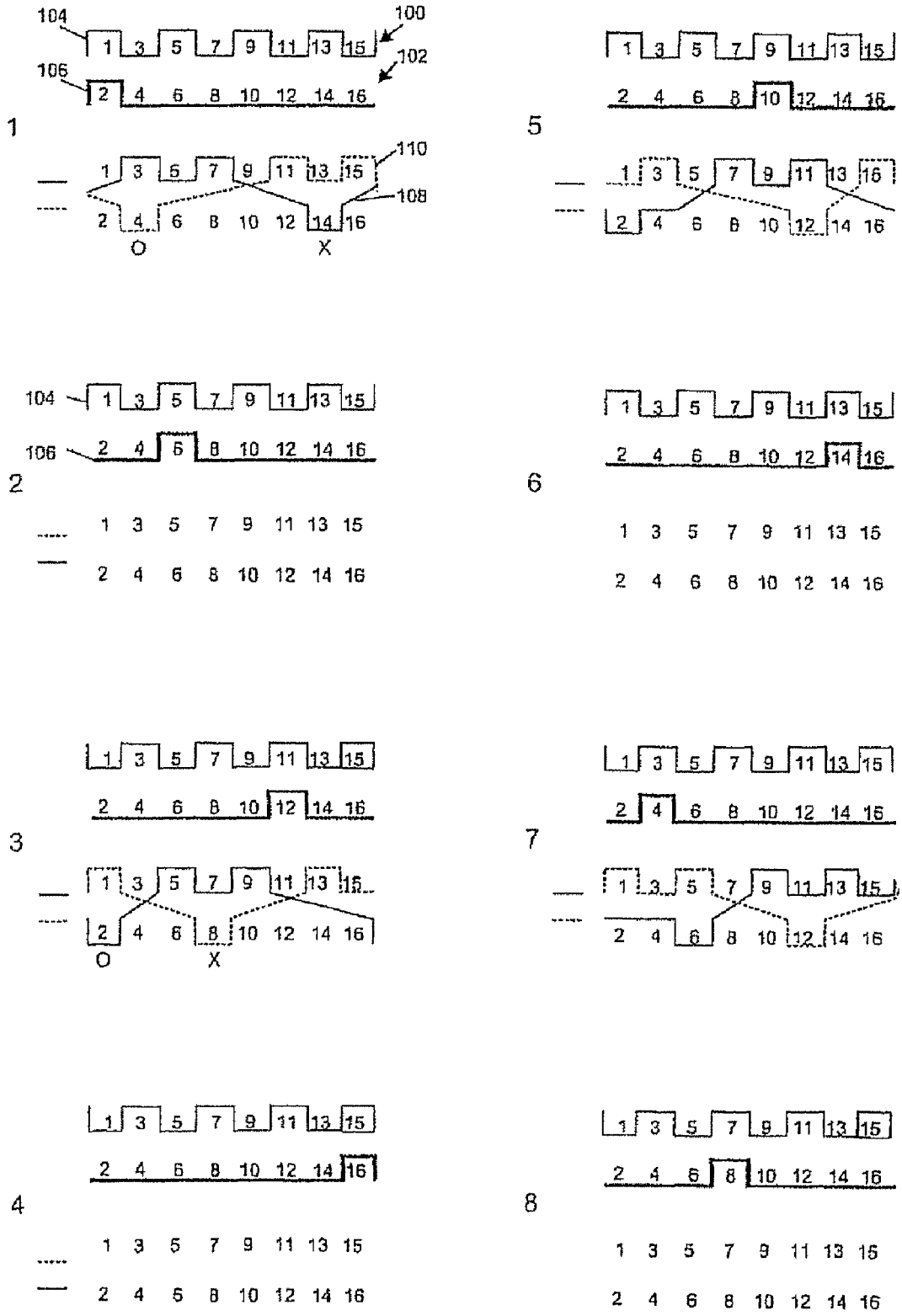
FIG. 23 is a depiction of an additional alternative arrangement, according to FIG. 2.
Figure 24:
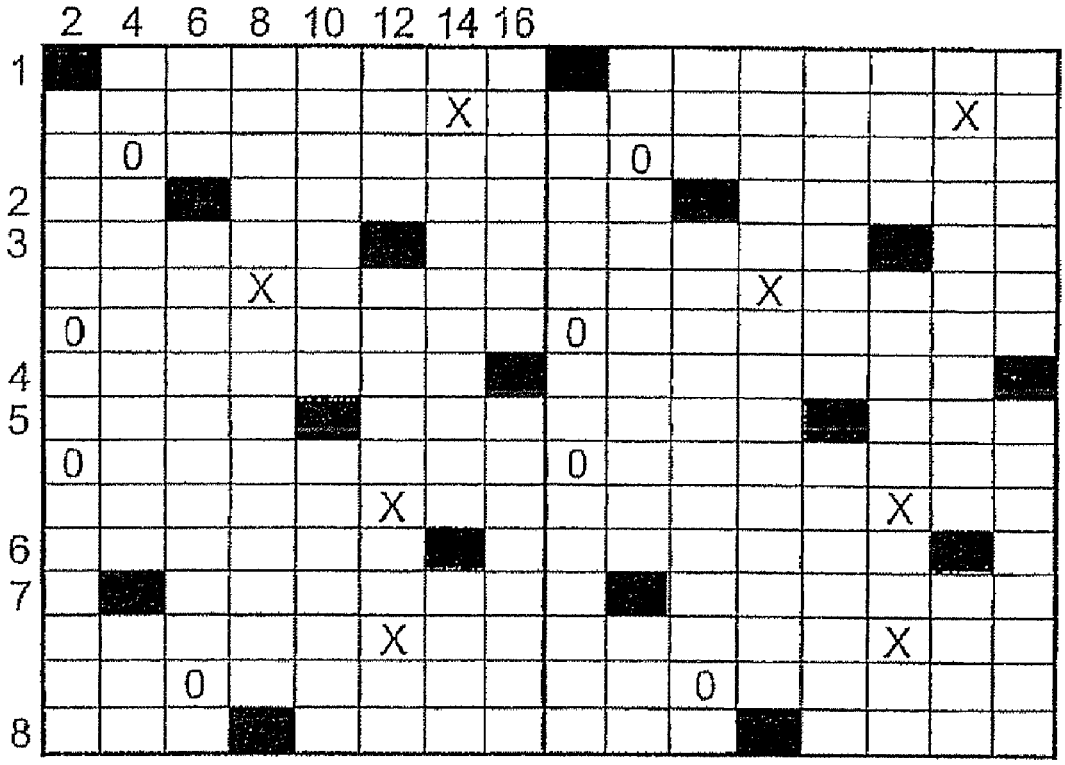
FIG. 24 is a depiction of the arrangement illustrated in FIG. 23, according to FIG. 3.
Figure 25:
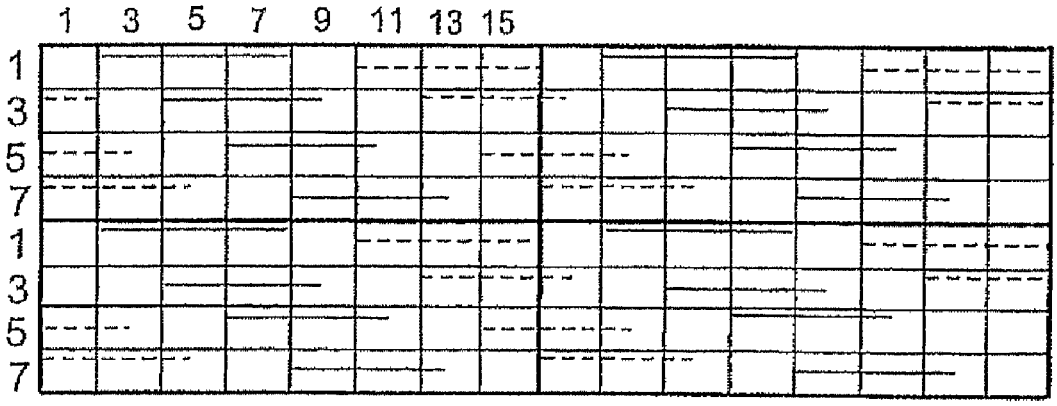
FIG. 25 is a depiction of the design arrangement illustrated in FIGS. 23 and 24, according to FIG. 19.

FIGS. 23 through 25 illustrate a design variation with a weft thread ratio of 3:2. This too is further explained by illustrating an example of weft thread groups 1 and 2 in FIG. 23. Here, the first fabric layer 100 contains the weft thread 104 of the first weft thread group 1, the segment of the binder threads 108, 110 of the first weft thread group 1 which form the basket weave and which in other words again produce a "weft thread", and the weft thread 104 of the second weft thread group. These three weft threads of the first fabric layer 100 are overlaid by the two weft threads 106 of the first weft thread group 1 and the second weft thread group 2, resulting in a ratio 3:2. Even with a weft ratio of this type the principle of the current invention can be applied. The weft threads 106 and the warp threads 2 through 16 of the second fabric layer are interwoven as depicted in the example in FIG. 7. In other words, they create an irregular 8-thread satin weave with the advantages arising from this. The segments of the binder threads 108, 110 which form the basket weave are again collectively arranged so that diagonal stripes result in which such segments are always present in the first fabric layer, so that also the crossing points shown in FIG. 25 accordingly form a diagonal pattern, as was the case in the previously discussed design variation.

Figure 26:
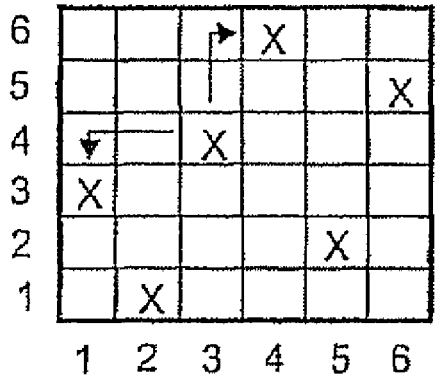
FIG. 26 is a pattern repeat, illustrated in the form of a weave-diagram for an alternative layout of an inventive forming fabric with a 6-thread irregular satin.
Figure 27:
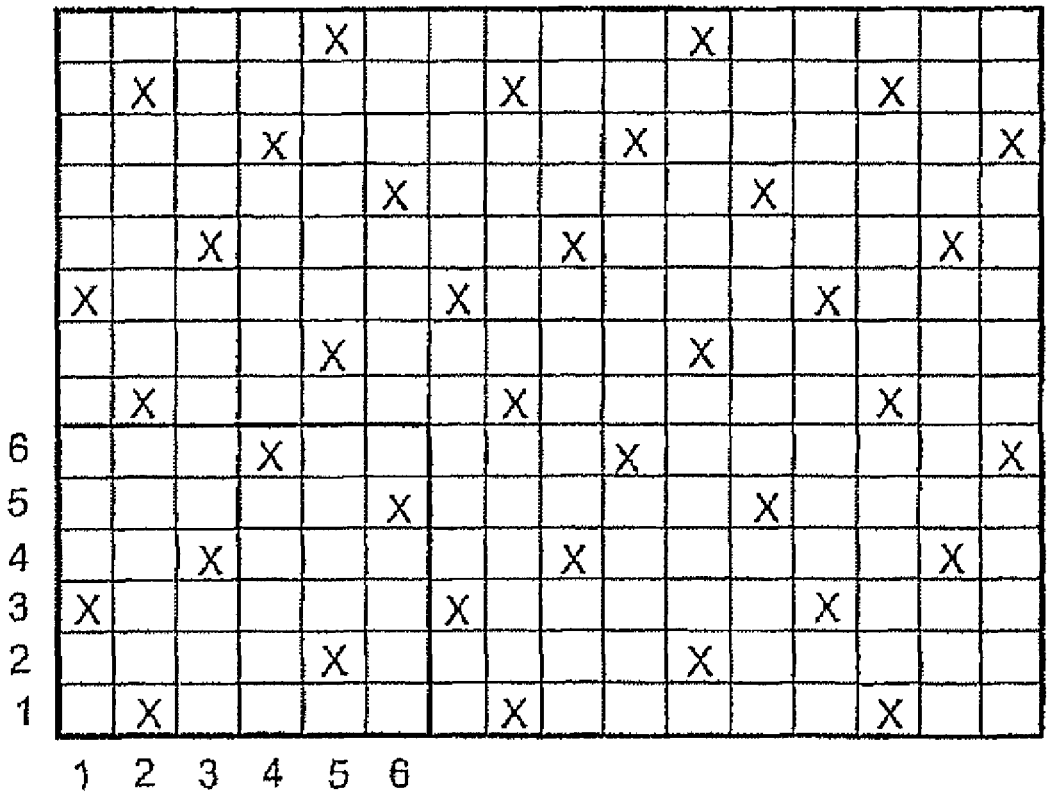
FIG. 27 is a plurality of grouped pattern repeats positioned adjacent to one another, according to FIG. 26.

An additional alternative design variation of a forming fabric structured in accordance with the current invention which may be utilized as a forming wire in machinery for the production of paper will be explained below, with reference to FIGS. 26 through 33. FIG. 26 illustrates a pattern repeat of the machine-side or backing-side second fabric layer which extends over the same number of warp threads and weft threads, as is also the case in all previously described forming fabrics. In the illustration in FIG. 26 the rows of squares always represent weft threads, while the columns of squares represent warp threads.

It can be seen in FIG. 26 that the pattern repeat illustrated there is an irregular 6-thread satin weave. One weft thread extends over one warp thread in each of the interlacing points indicated by "X" while in the non-marked squares the weft threads run under the warp threads. A warp sateen is being provided which, due to its irregularity provides the same effects as previously described, namely avoidance of distinctive diagonals which mark the first fabric layer which is the fabric layer that is in contact with the web material that is being produced. If an irregular 6-thread satin weave of this type is used for the second fabric layer it can be ensured, for example in combination with a basket weave for the first fabric layer, that uniform and irregular weave patterns are overlaid, thereby achieving the aforementioned advantageous results. In addition, the comparatively large floating length ensures that, for example the weft threads represent almost the entire machine-side surface and that based on an appropriate material selection the wear and tear at this comparatively heavily stressed side may be kept low. By selecting weft threads with larger diameters, a correspondingly greater wear volume can be provided.

Figure 28:
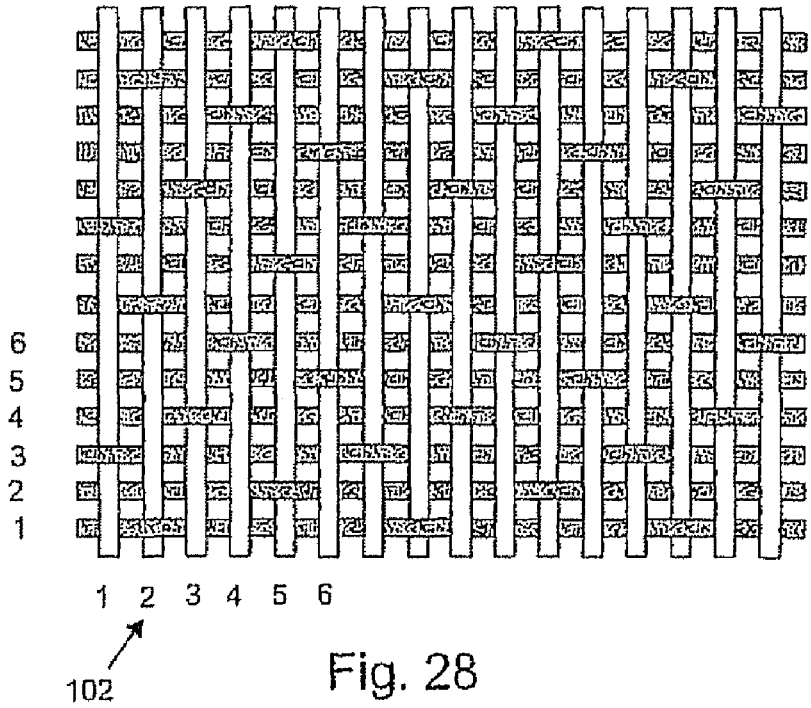
FIG. 28 is a top view onto a machine-side second fabric layer with warp satin in the repeat pattern illustrated in FIG. 26.
Figure 29:
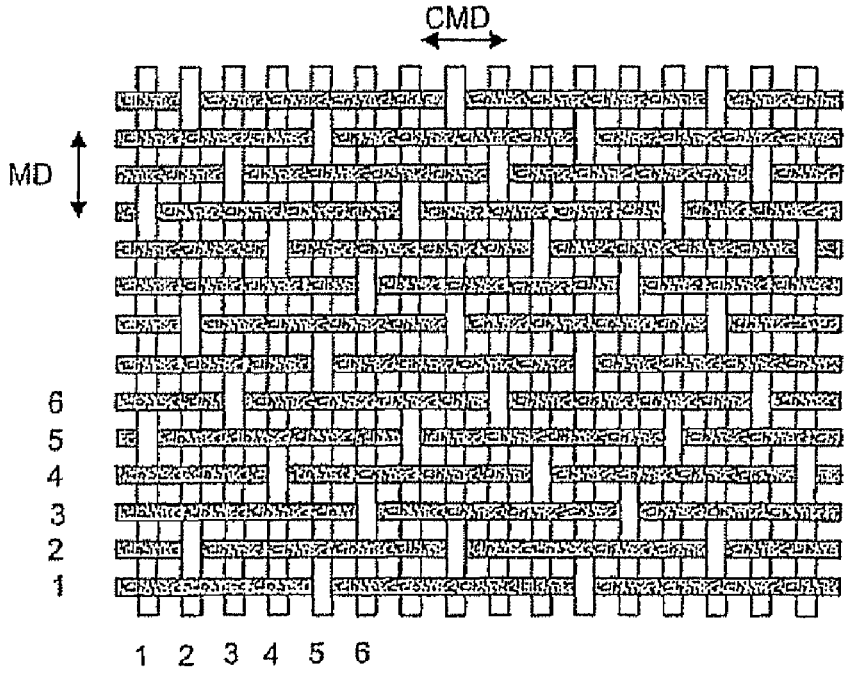
FIG. 29 is a depiction according to the illustration of FIG. 28 with weft satin.

By utilizing an irregular 6-thread satin weave of this type, in other words a satin weave whose pattern repeat extends in weft direction and in warp direction over the same number of threads, in this instance six threads respectively, a high quality forming fabric is achieved, whose material and structural characteristics may be influenced in different ways, as described below. It can be seen from the pattern example shown in FIG. 28 which depicts the second fabric layer 102 from above, in other words it shows the side facing the first fabric layer, that when utilizing the pattern repeat shown in FIG. 26 with irregular 6-thread satin weave for the second fabric layer a structure can be achieved in which the relative distances to each other of the horizontally extending weft threads is approximately uniform across the entire second fabric layer 102. Corresponding data applies to the mutual distance between the vertically extending warp threads. The same can be achieved if, as depicted in FIG. 29 the same pattern repeat is used in structuring a so-called weft satin. In contrast to the warp sateen illustrated in FIG. 28 the weft threads in this variation float on the side facing the first fabric layer, so that the warp threads float on the back side, that is on the backing-side surface of the forming fabric. The choice as to whether a warp sateen or a weft satin should be used can be made depending upon which of the threads, warp threads or weft threads are to extend in machine direction and which are to extend in cross-machine direction. Due to the uniform distance between the warp threads as well as the weft threads as shown in FIGS. 28 and 29 a uniform distribution of the contributing threads is overlaid over the irregularity of the 6-thread satin weave.

Figure 30:
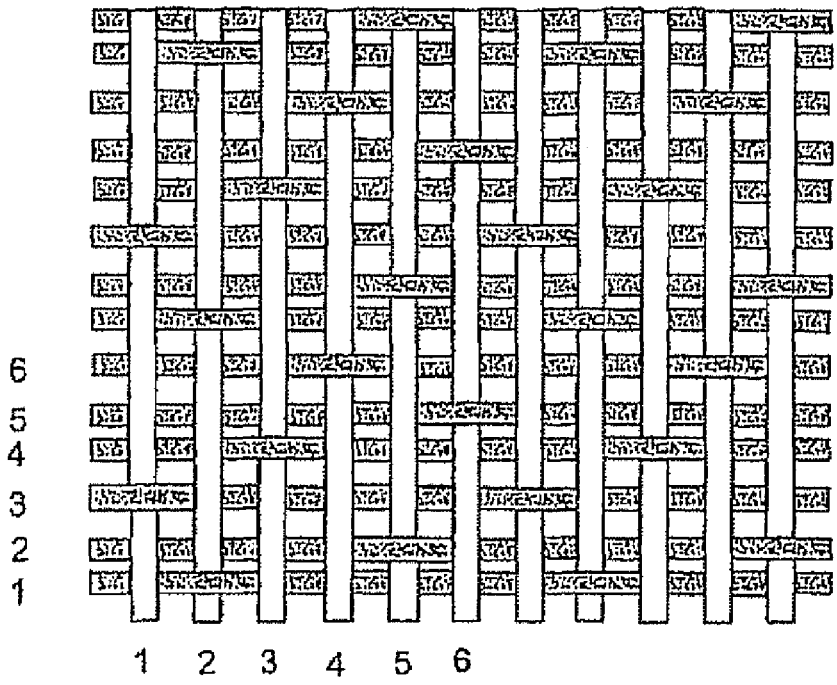
FIG. 30 is a depiction according to the illustration in FIG. 28, with pair formation of the weft threads.
Figure 31:
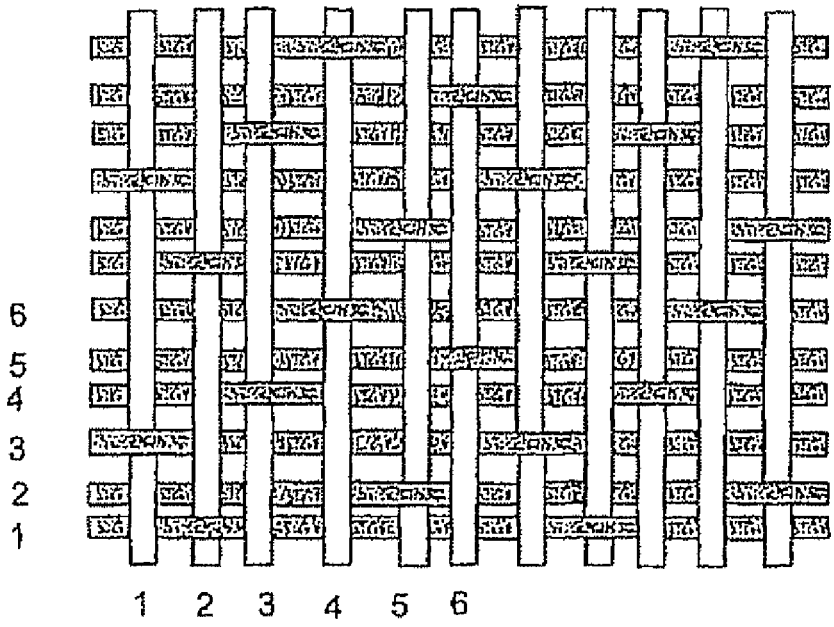
FIG. 31 is a depiction according to the illustration in FIG. 28, with pair formation of the warp threads.
Figure 32:
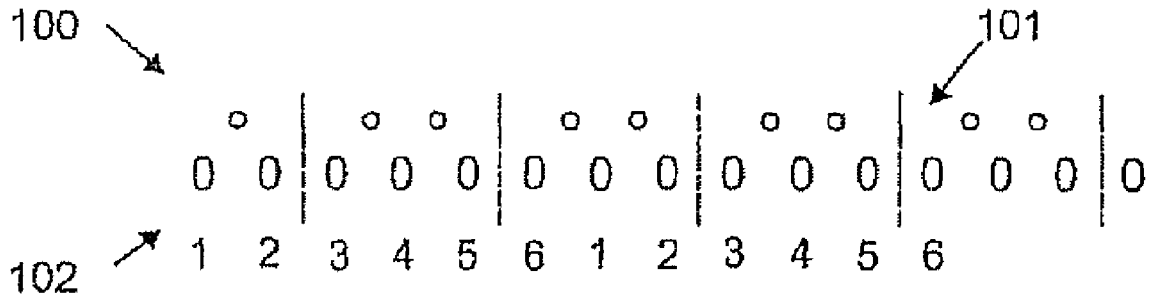
FIG. 32 is a warp section of a forming fabric, having a warp ratio of 2:3.

As in the example of the warp sateen shown in FIGS. 30 and 31, a paired grouping of the weft threads as shown in FIG.

30, or the warp threads as shown in FIG. 31 can be achieved by turning away from this uniform thread arrangement. For example, it can be seen in FIG. 30 that the weft threads 1 and 2 or 5 and 6 respectively form respective thread pairs within the pattern repeat including the weft threads 1 through 6 and the warp threads 1 through 6, whereby the threads 3 and 6 of this pattern repeat form between-pair threads, that is threads which are located at a greater distance from their adjacent thread pairs containing the threads 1, 2 or 4, 5 than the threads within a respective thread pair. The same applies for the pair grouping of warp threads shown in the depicted or numbered pattern repeat in FIG. 31, where the warp threads 2 and 3 or 5 and 6 respectively form a thread pair, while the warp threads 1 and 4 are located respectively between two thread pairs and are located at a greater distance from same, than the threads within a respective thread pair.

This effect of the grouping or pair formation can be utilized inventively in an advantageous manner. This is explained with the assistance of FIG. 32. This shows a warp profile, that is a profile of the pattern in FIG. 31 in weft direction in which therefore, the warp threads are depicted as a sectional drawing. One also recognizes the warp threads of the first fabric layer 100 and one recognizes that this is a warp ratio of 2:3. This means that three warp threads of the second fabric layer 102 combine with two warp threads of the first fabric layer 100 respectively. According to principles of the current invention it can then be further provided that, with this warp ratio the warp threads of the first fabric layer 100 always extend there where there is a larger distance between two immediately adjacent warp threads of the second fabric layer 102. This means that the warp threads of the first fabric layer 100 do not extend over or between the warp threads of the second fabric layer 102 which respectively form a pair, but extend above the space between a thread of a thread pair, for example the respective thread 3 of the thread pair 2-3 and a thread which is not allocated to a pair, for example thread 4. This achieves that the warp threads of the first fabric layer 100 can move closer toward the warp threads in the second fabric layer 102, possibly even dip into the spaces with greater clearance so that a thinner forming fabric 101 can be obtained at the same thread density.

This design can of course also be used if, as shown in FIG. 30 the weft threads are grouped in pairs, in which case a weft ratio of 2:3 can be selected.

The effect of the pair formation can also be utilized for a very space saving positioning of the binder threads which produce the interconnection between the first fabric layer 100 and the second fabric layer 102. This is explained in FIG. 33. In the following it is to be assumed that FIG. 33 also illustrates a warp profile that is a sectional of warp threads, sectioned in weft direction. In the design variation depicted in FIG. 33 the interconnection between the two fabric layers 100 and 102 is also not realized through weft threads as in the design variations discussed at the beginning, but instead through warp threads, whereby the warp threads 200 and 202 respectively form a warp thread pair which together realizes the interconnection. Also, as explained previously with regard to the weft threads, one of these warp threads 200, 202, together with the weft threads in the first fabric layer 100 forms for example a basket weave, while the other thread of this warp thread pair 200 or 202 is interconnected into the second fabric layer 102, providing the interconnection in this manner. After a change of these two warp threads, this other thread then forms the basket weave in the first fabric layer 100. With regard to the tie-in into the first fabric layer, a respective pair with warp threads 200 and 202 is in fact to be considered as a single warp thread.

Figure 33:
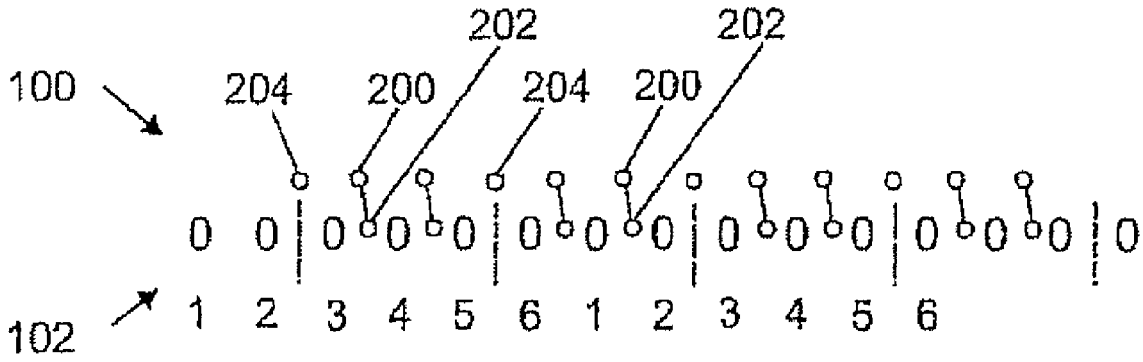
FIG. 33 is an alternative warp section of a forming fabric, having a warp ratio of 3:3

It can also be seen in FIG. 33 that, viewed in weft direction two such pairs 200, 202 are always located adjacent to each other and that a single warp thread 204 which is tied exclusively into the first fabric layer 100 extends between them. Since, as previously explained, the warp threads 200, 202 in the first fabric layer 100 which alternate in pairs and which can also be regarded as binder threads and which, with regard to the tie-in into the first fabric layer 100 are to be interpreted as a single thread, three warp threads of the first fabric layer 100 now combine with three warp threads in the second fabric layer in the arrangement depicted in FIG. 33. This represents a warp ratio of 3:3.

In this weave pattern the pair formation in the second fabric layer 102 is used so that at any location where a larger space is created between two warp threads of the second fabric layer 102, for example between warp threads 3 and 4 or 4 and 5 respectively that warp thread of a respective warp thread pair 200, 202 of the first fabric layer 100 which is not just being tied into the first fabric layer 100 is integrated into the second fabric layer 102. Since generally the threads, especially the warp threads of the first fabric layer 100 have a somewhat lesser thickness than the threads of the second fabric layer 102 the interconnection between the two fabric layers can be established, practically without having to provide additional space.

It is to be pointed out in this instant also, that obviously the interconnection between the two fabric layers 100 and 102 may also occur by way of weft threads, as previously explained, whereby then especially the weft thread group in the second fabric layer illustrated in FIG. 30 can be utilized in the same way. In this case the depiction in FIG. 33 would need to be regarded as a weft profile.

The influence to the effect as to whether the weft threads and/or the warp threads should be positioned at a uniform distance to each other as illustrated in FIGS. 28 and 29, or whether a paired grouping should be obtained, as illustrated in FIGS. 30 and 31 can be exercised in various ways. The influence can be realized through the type interlacing, that is through the predetermination of the relationship of the thread tension during the weaving process between the weft threads and the warp threads. Generally, one would proceed so that when using a firmly predetermined tension of the weft threads, basically the tension of the warp threads is varied so that the uniform distance that is achieved in FIGS. 28 and 29 may also be achieved in the center of a tension range. When deviating from this tension range, a grouping in the area of the weft threads or a grouping in the warp threads can be achieved, depending on the direction of the deviation. The grouping can also be achieved or prevented by predetermining the relationship of the diameters of the warp threads and the weft threads. In addition the grouping may be obtained by force or, an as even as possible distance between the individual threads be achieved through the filling character, that is through predetermination of the material filling ratio which is determined primarily by the thread density per length unit of a woven fabric and by the thread diameter. Here, the rule generally applies that the weft threads will make way, the lower the weft thread density becomes and the greater the warp thread density becomes. Accordingly, there are various parameters which can be adjusted in the weaving process and which with appropriate adjustment will lead to the desired weaving result.

It must be pointed out that the previously described inventive design variations of a forming fabric can obviously be further varied in various aspects without deviating from the principles of the current invention. It is obviously not imperative that the paper-side fabric layer is produced as a basket weave. Other types of weave, for example twill weave can also be used. The interconnection between the two fabric layers may be a structural interconnection whereby the warp threads or weft threads which produce this interconnection are also used to contribute to the interconnection that exists on the paper side, or the paper-side fabric layer. Alternatively, binder warp or binder weft threads can be used whose only purpose is to produce the interconnection between the two fabric layers, but are otherwise not used to realize a certain basic weave pattern in the paper-side, or backing-side fabric layer. It must also be emphasized that the various previously discussed inventive design variations can be utilized in so-called high-warp weaving machinery, that is machines which are equipped with a large number of shafts, for example as many as 60 shafts.

In summarizing it can be stated that a fundamental advantage of the inventive design is that an irregular satin weave is used in which the occurrence of dominant weave diagonals is avoided. Nevertheless, the invention utilizes the advantageous effect of comparatively long floating threads in the backing-side second fabric layer, whereby excessively long floating can be avoided, especially when using a 6-thread or 8-thread satin weave. By combining the irregularity in the weave pattern in the backing-side, second material layer with certain uniformities in the tie-in of the binder threads, especially advantageous effects are achieved. These uniformities may relate to the location of the crossing points of the binder threads, but they may also relate to the location of the interlacing points of said binder threads in the second fabric layer. The uniformity may be produced through an offset of the crossing points or interlacing points progressing in one same direction, or through an alternating offset of these crossing points or interlacing points.

In conclusion it is also pointed out in reference to the illustrated design variations that the threads extending in cross direction CMD are always represented as weft threads and the threads extending in longitudinal MD direction are represented as warp threads. Since generally forming fabrics of this type are longer than they are wide this represents an especially advantageous variation since the number of warp threads that have to be provided can be kept lower in this method. Obviously, the principles of the invention may also be applied to forming fabrics where the threads extending in longitudinal MD direction are the weft threads and the threads extending in cross direction CMD are the warp threads.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A forming fabric for a machine for producing a web of fibrous material, said forming fabric comprising:

a web-side first fabric layer;

a machine-side second fabric layer; and a plurality of binder threads, said first fabric layer and said second fabric layer being interconnected with each other by said plurality of binder threads, said second fabric layer being woven in an irregular satin weave, said web-side first fabric layer and said machine-side second fabric layer including a plurality of longitudinal threads extending in a longitudinal direction of the forming fabric and a plurality of cross threads extending in a cross direction of the forming fabric, said plurality of binder threads forming a plurality of binder thread pairs, each of said binder thread pairs in one of said longitudinal direction and said cross direction respectively extending between two said threads of said web-side first fabric layer and two said threads of said machine-side second fabric layer.

2. The forming fabric in accordance with claim 1, wherein said irregular satin weave is an irregular 8-thread satin weave.

3. The forming fabric in accordance with claim 1, wherein a floating of said cross threads of said second fabric layer extends on a side of said longitudinal threads of said second fabric layer facing away from said first fabric layer.

4. The forming fabric in accordance with claim 3, wherein said plurality of longitudinal threads are a plurality of warp threads and said plurality of cross threads are a plurality of weft threads.

5. The forming fabric in accordance with claim 3, wherein in one pattern repeat of said second fabric layer a plurality of interlacing points, which are formed between said longitudinal threads and said cross threads, are distributed such that at least two groups having three said interlacing points exist, with a distance that corresponds to one of a counter of two and a progressive number of two.

6. The forming fabric in accordance with claim 3, wherein in one pattern repeat of said second fabric layer a plurality of interlacing points, which are formed between said longitudinal threads and said cross threads, are distributed such that at least one group having five said interlacing points exists, with a distance relative to each other corresponding to one of a counter of two and a progressive number of two.

7. The forming fabric in accordance with claim 6, wherein in addition at least one group with three said interlacing points exists in said pattern repeat, with a distance relative to each other corresponding to one of a counter of two and a progressive number of two.

8. The forming fabric in accordance with claim 3, wherein in a pattern repeat of said second fabric layer a plurality of interlacing points, which are formed between said longitudinal threads and said cross threads, are distributed such that at least one group having four said interlacing points exists, with a distance relative to each other corresponding to at least one of a counter of two and a progressive number of two.

9. The forming fabric in accordance with claim 1, wherein, for each said binder thread pair, a first said binder thread of a respective said binder thread pair interconnects with said threads of said first fabric layer, while a second said binder thread of said respective binder thread pair interconnects with at least one said thread of said second fabric layer, and wherein said two binder threads of said respective binder thread pair change over at a crossing point, so that said second binder thread interconnects with said threads in said first fabric layer, while said first binder thread interconnects with at least one said thread in said second fabric layer.

10. The forming fabric in accordance with claim 9, wherein said crossing points of adjoining said binder thread pairs form a uniform crossing point pattern.

11. The forming fabric in accordance with claim 10, wherein, in a case of two immediately adjoining said binder thread pairs, no said binder thread should interconnect with a same said thread of said second fabric layer.

12. The forming fabric in accordance with claim 9, wherein said binder threads and said threads of said second fabric layer form therebetween a plurality of interlacing points, and wherein at least some of said interlacing points which are formed between said binder threads and said threads of said second fabric layer form a uniform interlacing point pattern.

13. The forming fabric in accordance with claim 9, wherein no said binder thread interconnects with a thread of said second fabric layer with which a thread of said second fabric layer, running immediately adjacent to this said binder thread, interconnects.

14. The forming fabric in accordance with claim 1, wherein said irregular satin weave is an irregular 6-thread satin weave.

15. The forming fabric in accordance with claim 14, wherein a floating of said cross threads of said second fabric layer extends on a side of the forming fabric on which said longitudinal threads of said second fabric layer are facing away from said first fabric layer.

16. The forming fabric in accordance with claim 15, wherein said plurality of longitudinal threads are a plurality of warp threads and said plurality of cross threads are a plurality of weft threads.

17. The forming fabric in accordance with claim 14, wherein at least one of said longitudinal threads of said second fabric layer extending in said longitudinal direction of the forming fabric and said cross threads of said second fabric layer extending in said cross direction of the forming fabric are arranged at an essentially uniform distance from each other.

18. The forming fabric in accordance with claim 14, wherein at least one of said longitudinal threads of said second fabric layer extending in said longitudinal direction of the forming fabric and said cross threads of said second fabric layer extending in a cross direction of the forming fabric are grouped in pairs, a distance of said threads within a respective said pair being less than a distance between said respective pair and another said thread adjoining said respective pair.

19. The forming fabric in accordance with claim 18, wherein said plurality of longitudinal threads are a plurality of warp threads and said plurality of cross threads are a plurality of weft threads, at least one of a weft ratio and a warp ratio of 2:3 existing between said first fabric layer and said second fabric layer.

20. The forming fabric in accordance with claim 19, wherein a thread of said first fabric layer extends over a space between one said pair and said thread of said second fabric layer adjoining said one pair.

21. The forming fabric in accordance with claim 18, wherein said plurality of longitudinal threads are a plurality of warp threads and said plurality of cross threads are a plurality of weft threads, at least one of a weft ratio and a warp ratio of 3:3 existing between said first fabric layer and said second fabric layer.

22. The forming fabric in accordance with claim 21, wherein in a space between one said pair and said thread of said second fabric layer a respective said thread adjacent to said pair, a respective said binder thread interconnecting said first fabric layer and said second fabric layer is tied into said second fabric layer.

23. A method for producing a forming fabric for a machine for producing a web of fibrous material, said method comprising the steps of:

weaving the forming fabric with a web-side first fabric layer and a machine-side second fabric layer;

interconnecting said first fabric layer and said second fabric layer with each other by a plurality of binder threads, said web-side first fabric layer and said machine-side second fabric layer including a plurality of longitudinal threads extending in a longitudinal direction of the forming fabric and a plurality of cross threads extending in a cross direction of the forming fabric, said plurality of binder threads forming a plurality of binder thread pairs, each of said binder thread pairs in one of said longitudinal direction and said cross direction respectively extending between two said threads of said web-side first fabric layer and two said threads of said machine-side second fabric layer; and weaving said second fabric layer in an irregular satin weave.

* * * * *